US011203462B1

(12) United States Patent
Ulla et al.

(10) Patent No.: US 11,203,462 B1
(45) Date of Patent: Dec. 21, 2021

(54) BEVERAGE CONTAINER SYSTEM AND ASSEMBLY

(71) Applicant: MERGE BOTTLE, LLC, Albany, NY (US)

(72) Inventors: Sibgat Ulla, Rensselaer, NY (US); Angelica Ulla, Rensselaer, NY (US)

(73) Assignee: Merg Bottle, LLC, Albany, NY (US)

( * ) Notice: Subject to any disclaimer, the term of this patent is extended or adjusted under 35 U.S.C. 154(b) by 0 days.

(21) Appl. No.: 16/504,187

(22) Filed: Jul. 5, 2019

Related U.S. Application Data

(60) Provisional application No. 62/752,291, filed on Oct. 29, 2018.

(51) Int. Cl.
*A47G 23/02* (2006.01)
*B65D 21/02* (2006.01)
*B65D 23/10* (2006.01)

(52) U.S. Cl.
CPC ..... *B65D 21/0201* (2013.01); *B65D 23/108* (2013.01); *B65D 2313/04* (2013.01)

(58) Field of Classification Search
CPC .... B65D 21/0237; B65D 25/40; A47G 19/14; A47G 23/0241; A47J 47/16; B67D 3/0083; B67C 9/00
USPC ..... 215/393, 394, 395; 220/631, 751, 737, 220/661; 222/164, 166, 181.2, 185.1
See application file for complete search history.

(56) References Cited

U.S. PATENT DOCUMENTS 295,849 A * 3/1884 Zimmer ..... A47G 23/0241 248/138
315,371 A * 4/1885 Anderson ..... A47G 23/0241 248/141
843,708 A * 2/1907 Sherrill ..... A47G 23/0241 248/141
1,164,465 A * 12/1915 Cash ..... A47G 23/0241 248/141
2,035,327 A * 3/1936 McCaffrey ..... B65D 7/22 220/592.27
6,286,719 B1 * 9/2001 Haines ..... B65D 81/36 222/113

(Continued)

FOREIGN PATENT DOCUMENTS

CA 2472794 A1 * 1/2005 ..... B29C 49/0073
CA 3014254 A1 * 2/2019

(Continued)

*Primary Examiner* — Allan D Stevens
(74) *Attorney, Agent, or Firm* — Invention To Patent Services; Alex Hobson

(57) ABSTRACT

The present disclosure provides a personal and dual container system including: at least a pair of beverage containers including a first large container and a second small container disposed in a containment section of the first large container, the large and the small containers include a cap member for closing a top end opening thereon; and a carrier device having a frame support member with top and bottom surfaces for removably attaching the large container thereto, and a plurality of extending frame members that are removably attached to at least a side wall of the large container and encompassing at least an upper portion and a lower portion of the small container. An improved beverage container assembly including: at least a pair of beverage containers including a first large container and a second small container disposed in a containment portion of the first large container.

8 Claims, 26 Drawing Sheets

(56) References Cited

U.S. PATENT DOCUMENTS

| | | | | |
|---|---|---|---|---|
| 6,318,594 | B1 * | 11/2001 | Hutchins | B65B 69/0091 222/1 |
| 9,745,115 | B2 | 8/2017 | Hall | |
| 2011/0100869 | A1 * | 5/2011 | Spann | B65D 21/0237 206/585 |
| 2012/0097291 | A1 * | 4/2012 | Almada | B67D 3/0032 141/2 |
| 2014/0252040 | A1 * | 9/2014 | Shoup | B67D 3/0083 222/160 |

FOREIGN PATENT DOCUMENTS

| | | | | | |
|---|---|---|---|---|---|
| DE | 729092 | C | * | 12/1942 | B65D 21/0237 |
| EP | 0294671 | A2 | * | 12/1988 | B65D 25/22 |
| FR | 583247 | A | * | 1/1925 | B65D 21/0237 |
| JP | 52010909 | A | * | 1/1977 | |

* cited by examiner

BEVERAGE CONTAINER SYSTEM AND ASSEMBLY

RELATED APPLICATION(S)

Under provisions of 35 U.S.C. § 119(e), Applicant claims the benefit of U.S. provisional application No. 62/752,291, entitled "Personal Beverage Container System," filed Oct. 29, 2018, which is incorporated herein by reference.

It is intended that each of the referenced applications may be applicable to the concepts and embodiments disclosed herein, even if such concepts and embodiments are disclosed in the referenced applications with different limitations and configurations and described using different examples and terminology.

FIELD OF DISCLOSURE

The present disclosure generally relates to devices and methods for accurately managing daily beverage consumption. More specifically, embodiments of the present disclosure relate to devices and methods for loading, storing, transporting, dispensing, blending and tracking precise consumption of beverages.

BACKGROUND

In some situations, hydration is essential for maintaining a healthy lifestyle. For example, dehydration may adversely impact many members of the populace. However, the dehydration is simply the adverse effect of inadequate water intake. For example, when the water level goes down in the body it can cause thirst, dry mouth, discomfort, loss of appetite, difficulty in concentrating, headache, dizziness and ultimately heat stroke which may result into death. Thus, the conventional strategy is to recommend daily water intake quotas to the public. This often causes problems because the conventional strategy does not always provide for easily accessible means to deliver adequate hydration means.

For example, there are many problems such as using large water containers instead of regular size bottles. Some problems include the lifting of a heavy 2-liter bottle and large container mouth openings which can cause beverages to spill on clothes and other surrounding items. In addition, securely transporting a large container can be difficult because it may not fit in a standard size car cup holder. Inadequate storage capacity for a large container could cause a beverage container to fall, roll or spill during transportation.

Therefore, the need exists for an improved beverage container system and method. This need and other needs are satisfied by the various aspects of the present disclosure.

BRIEF OVERVIEW

An improved beverage container assembly may be provided. This brief overview is provided to introduce a selection of concepts in a simplified form that are further described below in the Detailed Description. This brief overview is not intended to identify key features or essential features of the claimed subject matter. Nor is this brief overview intended to be used to limit the claimed subject matter's scope.

The present disclosure may provide a personal and dual container system comprising: at least a pair of beverage containers, the at least a pair of beverage containers includes a first large container and a second small container disposed in a containment section of the first large container, the large and the small containers include a cap member for closing a top end opening thereon; and a carrier device having a frame support member with top and bottom surfaces for removably attaching the large container thereto, and a plurality of extending frame members that are removably attached to at least a side wall of the large container and encompassing at least an upper portion and a lower portion of the small container.

Furthermore, the present disclosure may provide an improved beverage container assembly comprising: at least a pair of beverage containers, the at least a pair of beverage containers includes a first large container and a second small container disposed in a containment portion of the first large container; the large container includes a pair of side wall portions, a front end portion, a rear end portion and a top open end portion with an opening for receiving a cap member, the pair of side walls having a guide and roller member disposed at a bottom end thereof for selectively positioning the large container in multiple positions defining a storage and transport mode and a dispensing mode, the front end portion includes a valving and protective device at bottom end thereof and a handle member attached at a location on the rear end portion for carrying and easily moving the large container between the storage and transport mode and a dispensing mode; and a carrier device having a frame base member with a top base surface for supporting the large container thereon, a pair of upstanding frame members that are removably attached to a pair of opposite side walls of the frame base member for slidably guiding the large container between the multiple selective positions, and a front frame base open wall end and a rear frame base open wall end disposed at opposite ends of the base member.

Additional aspects of the disclosure will be set forth in part in the description which follows, and in part will be obvious from the description, or can be learned by practice of the disclosure. The advantages of the disclosure will be realized and attained by means of the elements and combinations particularly pointed out in the appended claims. It is to be understood that both the foregoing general description and the following detailed description are exemplary and explanatory only and are not restrictive of the disclosure, as claimed.

Both the foregoing brief overview and the following detailed description provide examples and are explanatory only. Accordingly, the foregoing brief overview and the following detailed description should not be considered to be restrictive. Further, features or variations may be provided in addition to those set forth herein. For example, embodiments may be directed to various feature combinations and sub-combinations described in the detailed description.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicant. In addition, the drawings may contain other marks owned by third parties and are being used for illustrative purposes only. All rights to various trademarks and copyrights represented herein, except those belonging to their respective owners, are vested in and the property of the Applicant. The Applicant retains and reserves all rights in its trademarks and copyrights included herein, and grants permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure. The accompanying drawings, which are incorporated in and constitute a part of this specification, illustrate several aspects of the disclosure and together with the description, serve to explain the principles of the disclosure.

DETAILED DESCRIPTION

Figure 1:
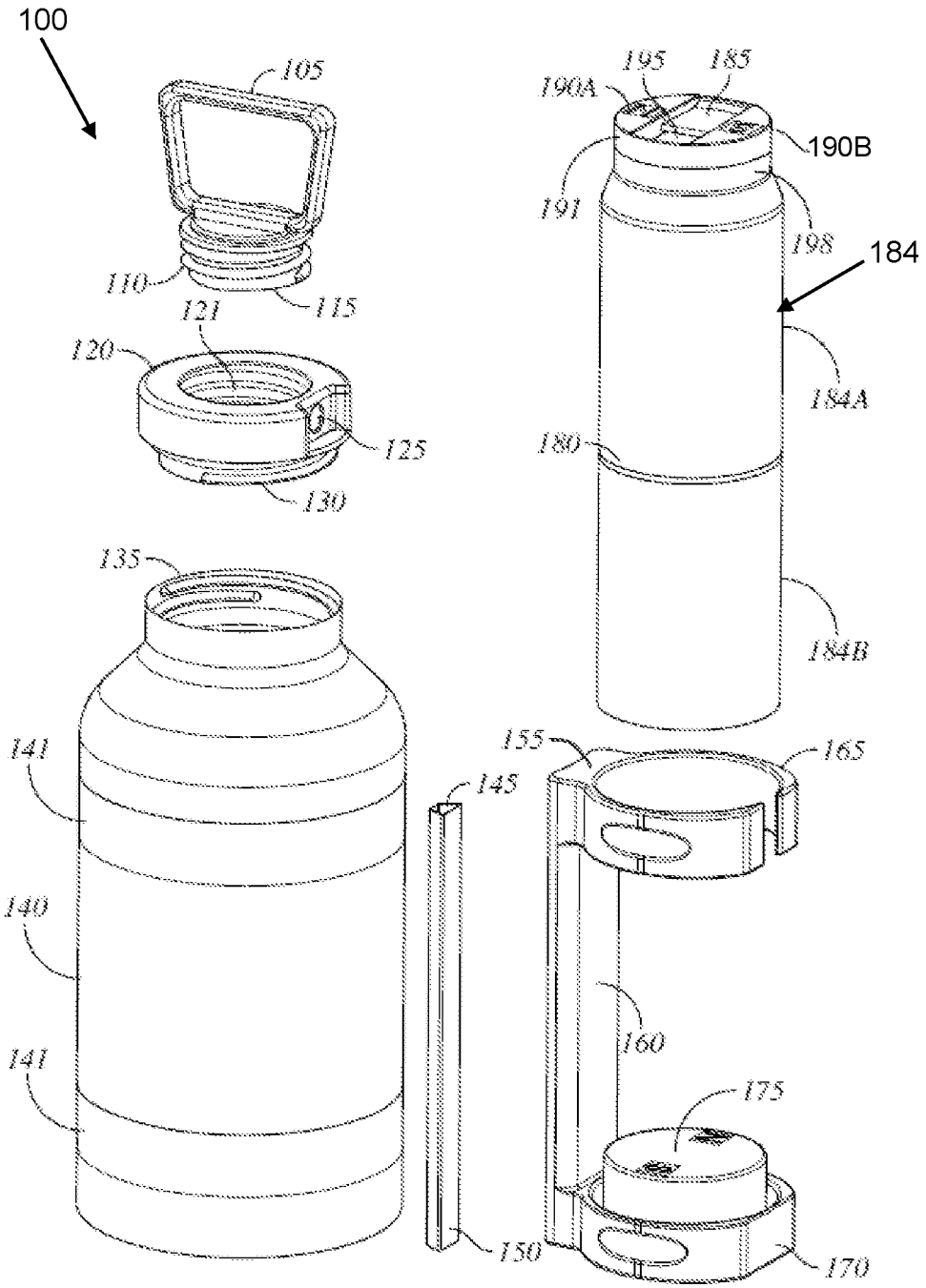
FIGS. 1, 2, 3, 4, 5, 6, 7, 8 and 9 show depictions of exemplary embodiments of the present disclosure.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Regarding applicability of 35 U.S.C. § 112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

The present disclosure can be understood more readily by reference to the following detailed description of the disclosure and the Examples included therein.

Before the present articles, systems, devices, and/or methods are disclosed and described, it is to be understood that they are not limited to specific manufacturing methods unless otherwise specified, or to particular materials unless otherwise specified, as such can, of course, vary. It is also to be understood that the terminology used herein is for the purpose of describing particular aspects only and is not intended to be limiting. Although any methods and materials similar or equivalent to those described herein can be used in the practice or testing of the present disclosure, example methods and materials are now described.

All publications mentioned herein are incorporated herein by reference to disclose and describe the methods and/or materials in connection with which the publications are cited.

A. Definitions

It is also to be understood that the terminology used herein is for the purpose of describing particular aspects only and is not intended to be limiting. As used in the specification and in the claims, the term "comprising" can include the aspects "consisting of" and "consisting essentially of." Unless defined otherwise, all technical and scientific terms used herein have the same meaning as commonly understood by one of ordinary skill in the art to which this disclosure belongs. In this specification and in the claims which follow, reference will be made to a number of terms which shall be defined herein.

As used in the specification and the appended claims, the singular forms "a," "an" and "the" include plural referents unless the context clearly dictates otherwise. Thus, for example, reference to "an opening" can include two or more openings.

Ranges can be expressed herein as from one particular value, and/or to another particular value. When such a range is expressed, another aspect includes from the one particular value and/or to the other particular value. Similarly, when values are expressed as approximations, by use of the antecedent 'about,' it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed. As used herein, the terms "about" and "at or about" mean that the amount or value in question can be the value designated some other value approximately or about the same. It is generally understood, as used herein, that it is the nominal value indicated ±10% variation unless otherwise indicated or inferred. The term is intended to convey that similar values promote equivalent results or effects recited in the claims. That is, it is understood that amounts, sizes, formulations, parameters, and other quantities and characteristics are not and need not be exact, but can be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such. It is understood that where "about" is used before a quantitative value, the parameter also includes the specific quantitative value itself, unless specifically stated otherwise.

The terms "first," "second," "first part," "second part," and the like, where used herein, do not denote any order, quantity, or importance, and are used to distinguish one element from another, unless specifically stated otherwise.

As used herein, the terms "optional" or "optionally" means that the subsequently described event or circumstance can or cannot occur, and that the description includes instances where said event or circumstance occurs and instances where it does not. For example, the phrase "optionally affixed to the surface" means that it can or cannot be fixed to a surface.

Moreover, it is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

Disclosed are the components to be used to manufacture the disclosed devices, systems, and articles of the disclosure as well as the devices themselves to be used within the methods disclosed herein. These and other materials are disclosed herein, and it is understood that when combinations, subsets, interactions, groups, etc. of these materials are disclosed that while specific reference of each various individual and collective combinations and permutation of these materials cannot be explicitly disclosed, each is specifically contemplated and described herein. For example, if a particular material is disclosed and discussed and a number of modifications that can be made to the materials are discussed, specifically contemplated is each and every combination and permutation of the material and the modifications that are possible unless specifically indicated to the contrary. Thus, if a class of materials A, B, and C are disclosed as well as a class of materials D, E. and F and an example of a combination material, A-D is disclosed, then even if each is not individually recited each is individually and collectively contemplated meaning combinations, A-E, A-F, B-D, B-E, B-F, C-D, C-E, and C-F are considered disclosed. Likewise, any subset or combination of these is also disclosed. Thus, for example, the sub-group of A-E, B-F, and C-E would be considered disclosed. This concept applies to all aspects of this application including, but not limited to, steps in methods of making and using the articles and devices of the disclosure. Thus, if there are a variety of additional steps that can be performed it is understood that each of these additional steps can be performed with any specific aspect or combination of aspects of the methods of the disclosure.

It is understood that the devices and systems disclosed herein have certain functions. Disclosed herein are certain structural requirements for performing the disclosed functions, and it is understood that there are a variety of structures that can perform the same function that are related to the disclosed structures, and that these structures will typically achieve the same result.

The present disclosure includes many aspects and features. Moreover, while many aspects and features relate to, and are described in, the context of an improved beverage container system and assembly, embodiments of the present disclosure are not limited to use only in this context.

Consistent with embodiments of the present disclosure, an improved beverage container system and assembly may be provided. This overview is provided to introduce a selection of concepts in a simplified form that are further described below. This overview is not intended to identify key features or essential features of the claimed subject matter. Nor is this overview intended to be used to limit the claimed subject matter's scope. The improved beverage container system and assembly may be used by individuals or companies as a means to deliver adequate hydration and transport one or more beverages.

The present disclosure provides a personal and dual container system comprising: at least a pair of beverage containers, the at least a pair of beverage containers includes a first large container and a second small container disposed in a containment section of the first large container, the large and the small containers include a cap member for closing a top end opening thereon; and a carrier device having a frame support member with top and bottom surfaces for removably attaching the large container thereto, and a plurality of extending frame members that are removably attached to at least a side wall of the large container and encompassing at least an upper portion and a lower portion of the small container.

In another aspect, the present disclosure provides an improved beverage container assembly comprising: at least a pair of beverage containers, the at least a pair of beverage containers includes a first large container and a second small container disposed in a containment portion of the first large container; the large container includes a pair of side wall portions, a front end portion, a rear end portion and a top open end portion with an opening for receiving a cap member, the pair of side walls having a guide and roller member disposed at a bottom end thereof for selectively positioning the large container in multiple positions defining a storage and transport mode and a dispensing mode, the front end portion includes a valving and protective device at bottom end thereof and a handle member attached at a location on the rear end portion for carrying and easily moving the large container between the storage and transport mode and a dispensing mode; and a carrier device having a frame base member with a top base surface for supporting the large container thereon, a pair of upstanding frame members that are removably attached to a pair of opposite side walls of the frame base member for slidably guiding the large container between the multiple selective positions, and a front frame base open wall end and a rear frame base open wall end disposed at opposite ends of the base member.

Although components are disclosed with specific functionality, it should be understood that functionality may be shared between components, with some functions split between components, while other functions duplicated by the components. Furthermore, the name of the component should not be construed as limiting upon the functionality of the component. Moreover, each stage in the claim language can be considered independently without the context of the other stages. Each stage may contain language defined in other portions of this specifications. Each stage disclosed for one component may be mixed with the operational stages of another component. Each stage can be claimed on its own and/or interchangeably with other stages of other components. The following claims will detail the operation of each component, and inter-operation between components.

Although the stages are disclosed in a particular order, it should be understood that the order is disclosed for illustrative purposes only. Stages may be combined, separated, reordered, and various intermediary stages may exist. Accordingly, it should be understood that the various stages, in various embodiments, may be performed in arrangements that differ from the ones claimed below. Moreover, various stages may be added or removed from the without altering or deterring from the fundamental scope of the depicted methods and systems disclosed herein.

Finally, the claims are not structured in the same way non-provisional claims are structured. For example, indentations indicate optional/dependent elements of a parent element.

The present disclosure provides for at least:

An improved dual container system comprising:

at least a pair of beverage containers, the at least a pair of beverage containers includes a first large container and a second small container disposed in a containment section of the first large container, the large and the small containers include a cap member for closing a top end opening thereon;

a carrier device having a frame support member with top and bottom surfaces for removably attaching the large container thereto, and a plurality of extending frame members that are removably attached to at least a side wall of the large container and encompassing at least an upper portion and a lower portion of the small container; and wherein the small container includes at least a pair of small containers, the at least a pair of small containers having a first small container that includes a magnetic lid cap removably attached to a top open end thereof, the magnetic cap lid having lid opening with a magnet disposed on opposite sides of the lid opening with opposite pole orientations, a lid closure member for opening and closing the lid opening for filling, dispensing and non-dispensing, a base magnet member disposed in a lower end of the first small container, the base magnet member having an opening with a magnet disposed on opposite sides of the base magnet member opening with opposite pole orientations, the at least a pair of small containers having a second small container that includes a magnetic lid cap removably attached to a top open end thereof, the magnetic cap lid having lid opening with a magnet disposed on opposite sides of the lid opening with opposite pole orientations, a lid closure member for opening and closing the lid opening for filling, dispensing and non-dispensing, a base magnet member disposed in a lower end of the at least a pair of small containers, the base magnet member having an opening with a magnet disposed on opposite sides of the base magnet member opening with opposite pole orientations, the second small container is inserted into the lower end of the first small container below the base magnet member and securely connected thereto when the opposite pole orientations of the magnets ofthe base magnet member of the first container and the magnets of the magnetic cap lid of the second container are moved until they become magnetically attracted to one another, the second container is released from the first container when the magnets of the magnetic cap lid of the second container are moved to a position where the magnets of the base magnet member of the first container are no longer magnetically attracted to one another, and the bottom end of the second small container below the base magnet member thereof includes a sealing base member for maintaining beverage therein. In one or more embodiments, the at least a pair of small containers may be interchangeable, stackable, and interchangeably stackable.

In another aspect, the present disclosure provides for at least:

An improved beverage container assembly comprising:

at least a pair of beverage containers, the at least a pair of beverage containers includes a first large container and a second small container disposed in a containment portion of the first large container;

the large container includes a pair of side wall portions, a front end portion, a rear end portion and a top open end portion with an opening for receiving a cap member, the pair of side walls having a guide and roller member disposed at a bottom end thereof for selectively positioning the large container in multiple positions defining a storage and transport mode and a dispensing mode, the front end portion includes a valving and protective device at bottom end thereof and a handle member attached at a location on the rear end portion for carrying and easily moving the large container between the storage and transport mode and a dispensing mode; and a carrier device having a frame base member with a top base surface for supporting the large container thereon, a pair of upstanding frame members that are removably attached to a pair of opposite side walls of the frame base member for slidably guiding the large container between the multiple selective positions, and a front frame base open wall end and a rear frame base open wall end disposed at opposite ends of the base member.

In yet another aspect, the present disclosure provides for at least:

A personal and dual container system comprising:

at least a pair of beverage containers, the at least a pair of beverage containers includes a first large container and a second small container disposed in a containment section of the first large container, the large and the small containers include a cap member for closing a top end opening thereon; and a carrier device having a frame support member with top and bottom surfaces for removably attaching the large container thereto, and a plurality of extending frame members that are removably attached to at least a side wall of the large container and encompassing at least an upper portion and a lower portion of the small container.

Both the foregoing overview and the following detailed description provide examples and are explanatory only. Accordingly, the foregoing overview and the following detailed description should not be considered to be restrictive. Further, features or variations may be provided in addition to those set forth herein. For example, embodiments may be directed to various feature combinations and subcombinations described in the detailed description.

FIGS. 1-50 illustrates one possible operating environment through which an improved beverage container system, assembly and apparatus consistent with embodiments of the present disclosure may be provided.

FIGS. 1, 2, 3, 4, 5, 6, 7, 8 and 9 illustrate non-limiting examples of operating environments for the aforementioned components. Although components are disclosed with specific functionality, it should be understood that functionality may be shared between components, with some functions split between components, while other functions duplicated by the components. Furthermore, the name of the component should not be construed as limiting upon the functionality of the component. Moreover, each stage in the claim language can be considered independently without the context of the other stages. Each stage may contain language defined in other portions of this specifications. Each stage disclosed for one component may be mixed with the operational stages of another component. Each stage can be claimed on its own and/or interchangeably with other stages of other components.

The following will detail the operation of each component, and inter-operation between components. FIGS. 1, 2, 3, 4, 5, 6, 7, 8 and 9 all show various views and embodiments of an improved beverage container assembly depicted as 100. The various elements and-components are herein described in detail by associated reference numbers. Details relating to each reference number are not restated for each figure.

Disclosure provides sufficient detail to-match function and description to the appropriate reference number for the purposes of this specification.

FIG. 1 shows a perspective view of an improved beverage container assembly 100 in accordance with an embodiment of the present disclosure. FIG. 1 show a handle lid of the improved beverage container assembly 100. Lid handle 105 may be configured to carry the improved beverage container assembly 100. Rotation of the lid handle 105 clockwise and/or counter clockwise may enable a small dispensing aperture 125 of the improved beverage container assembly 100 to open for dispensing a beverage or close to prevent a beverage from dispensing. Lid handle 105 may be further adapted to support the weight of the improved beverage container assembly 100 during a transport mode. FIG. 1, shows a handle or lid connector 110 configured to connect lid handle 105 by means of a temporary connection including but not limited to a threaded or press fit. FIG. 1, shows the bottom surface 115 of lid handle 105. The bottom surface 115 may be configured to be a cap for the improved beverage container. As mentioned above the rotational positioning of the lid handle 105 may enable the small dispensing aperture 125 of the improved beverage container assembly 100 to open for dispensing a beverage or close to prevent a beverage from dispensing. In one or more other aspects, a finger grips may be added to enable easy handling of lid handle 105. FIG. 1, shows a mouth adapter 120 for the improved beverage container assembly 100. The mouth adapter 120 may be configured to temporarily connect the lid handle 105 and the main container 140. In one aspect, mouth adapter 120 may be placed in between lid handle 105 and the main container 140. When the lid handle 105 is fully detached from main container 140, the mouth adapter 120 may enable more efficient beverage filling or dispensing from main container 140.

Mouth adapter 120 may further enable a beverage to be dispensed from either small dispensing aperture 125 or large dispensing aperture 121. Large dispensing aperture 121 becomes available once lid handle 105 is completely detached from the main container 140. Large dispensing aperture 121 may enable beverage dispensation from the small dispensing aperture 125 when lid connector 110 is rotationally position such that it is not obstructing small dispensing aperture 125. FIG. 1, shows the small dispensing aperture 125 for the improved beverage container assembly 100 which may be closed and opened based on the rotational position of the lid handle 105 and subsequent position of handle or lid connector 110. Small dispensing aperture 125 may include, but is not be limited to a spout, aperture, or dispenser opening.

The shape of small dispensing aperture 125 may be circular, square, rectangular, diamond, or any other shape facilitating the function of dispensing fluids. In one or more aspects, a seal or gasket may be added between lid handle 105 and mouth adapter 120 to prevent leaking. In one or more other aspects, an aperture cap may be added to prevent dust from entering mouth adapter 120, and aperture cap may be tethered to the lid handle 105. The aperture cap may seal or prevent any beverage from leaking from small dispensing aperture 125. In one or more aspects, a seal or gasket may be added between mouth adapter 120 and main container connector 135 to prevent leaking.

FIG. 1, shows a mouth adapter connector 130 configured to connect to the main container 140 by means of temporary connection including but not limited to a threaded means, interlocking means, or press fit mechanism. FIG. 1, shows a main container connector 135 configured to connect to the mouth adapter 120 and the main container 140 by means of temporary connection including but not limited to a threaded means, interlocking means, or press fit mechanism. FIG. 1, shows the main container 140 configured to store, hold, or transport any beverage. The size of the main container 140 includes but is not limited to 8 ounces, 16 ounces, 32 ounces, 64 ounces, 128 ounces larger. The shape of main container 140 includes but is not limited to circular, cylindrical, rectangular, trapezoidal, and other shapes. Main container 140 may be manufactured by at least one of vacuum insulated technology, blow molding, injection molding, or other fabrication method.

FIG. 1, shows a main container deboss 141. The main container deboss is configured to allow belts, strap, clamps or other mechanical devices to wrap around main container 140 in a manner such that main container 140 may be connected to various places including but not limited to bicycle poles, tree branches, fences, gym equipment members, and other supporting members. FIG. 1, shows a side connector 145 configured to be an integral connector between main container 140 and auxiliary container assembly 160. Side connector 145 may be configured in various sizes, varying quantities, and a variety of shapes including but not limited to hollow, solid, trapezoidal, circular, rectangular and the like. The side connector may be affixed to main container 140 by means of welding, over molding, gluing, direct embossing onto the main container 140. In one aspect, side connector 145 may be connected by a magnetic means. Side connector may affix from a top side or bottom side of the main container 140. FIG. 1, shows the larger dorsal side 150 of the side connector 145—which are trapezoidal shapes. The side connector 145 is not limited to this shape and may be configured as a bar connector between main container 140 and auxiliary container assembly 160. Enables locking of the guideway 155 and ensures it cannot be detached axially.

Figure 9:
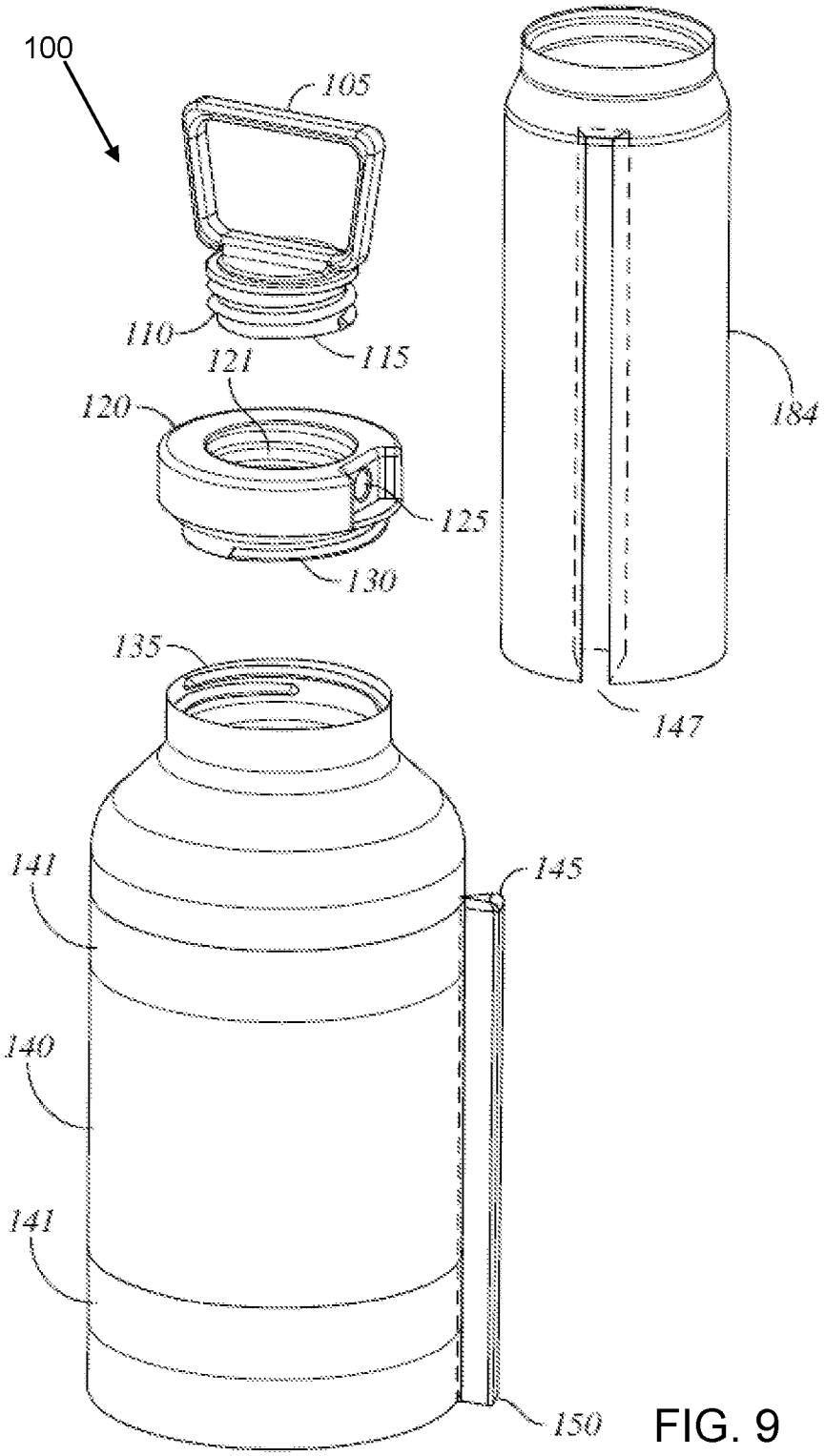

FIG. 1, shows a guideway connected to a container assembly 160 as the female side of the side connector 145. In one aspect, auxiliary container assembly 160 and at least one side of the main container 140 may have an interchangeably female side or male side connector. In one aspect, guideway 155 may be connected to side connector 145 with a magnet to secure or lock the position of auxiliary container assembly 160. The magnet may be configured to attach inside the guideway 155 on the topside. FIG. 1, shows a top bracket holder 165 connected to auxiliary container assembly 160 in a manner configured to secure small container assembly 184 (shown in FIG. 6). FIG. 1, shows a bracket base 170 connected to auxiliary container assembly 160 which is configured to support the entire beverage container system during dispensing mode which may also be referred to as piggyback mode. FIG. 1, shows a magnetic mount base 175 configured to interlock with a small container assembly 184. In one or more embodiments, the container assembly may comprise a first container 184A and second container 184B. First container 184A magnetically affixed to second container 184B. FIG. 1, shows the connection 180 between first container 184A and second container 184B that is identical in large outer diameter. First container 184A may be a top container. Second container 184B may be a bottom container. First container 184A and second container 184B may be the same size or different sizes. They may also be configured to be any shape including but not limited to circular and rectangular. FIG. 9 shows an alternative embodiment wherein side connector 145, having a guideway is affixes to the chassis surface of main container 140. FIG. 9 also shows small container assembly 184 having a recessed connector channel 147.

Both first container 184A and second container 184B have uppermost surfaces comprising various components including but not limited to: a container lid 191 configured to securely hold magnet poles and flip lid 185. Container lid 191 with lid magnets 190A, 190B having magnet poles may be manufactured integrally by at least one of vacuum insulated technology, blow molding, insert molding, injection molding, or other fabrication method. In one more instance the lid magnets 190A, 190B may be attached to lid 191 by means of adhesive, weld, screw or other mechanical fastening. Container lid 191 connects the first and second containers 184A and 184B. In one or more instances the container lids 191 may have identical small outer diameters 198; a room or recess compartment for flip-lid 185, wherein the room or recess compartment for flip lid is configured to move up to 180 degrees.

In one aspect, a flip lid room or recess compartment may be used to configure a handle for both first container 184A and second container 184B. Handle is configured to move along flip lid 185 up to 180 degrees. The room for flip-lid 185 may be a space that can be used for a logo; the flip lid 185, wherein the flip lid 185 may be the top of auxiliary container assembly 184A. The flip lid 185 may be configured to cap, cover, or dispense a beverage. The flip lid 185 may be have up to 180 degrees of movement; and at least one container lid magnet 190A, wherein one magnet pole orientation is south and another is north. In one or more embodiments, there are at least a pair of container lid magnets 190A positioned such that the magnetic pole orientation is opposite which enables holding larger load in an axial direction while rotating along that axis with simple torsion causes the magnetic force to release and the containers 184A and 184B to detach. The magnets 190A on first container 184A and second container 184B may be the same size or different sizes. They may also be configured to a variety of shapes including but not limited to circular, square and rectangular.

Figure 3:
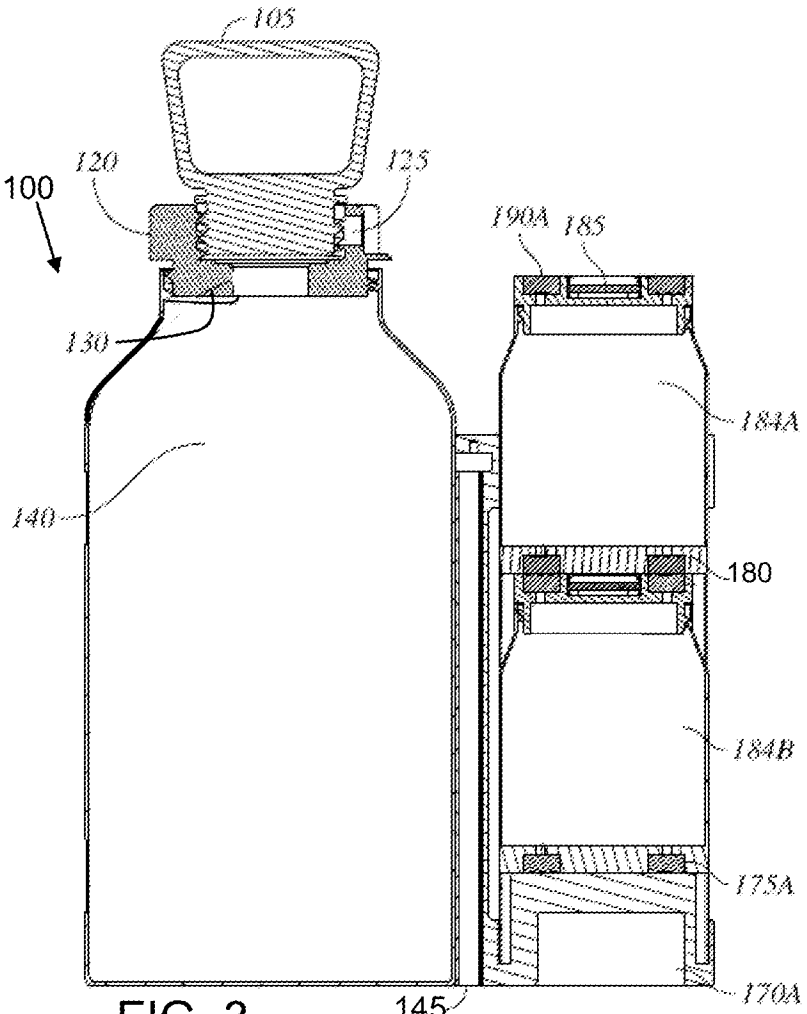
Figure 2:
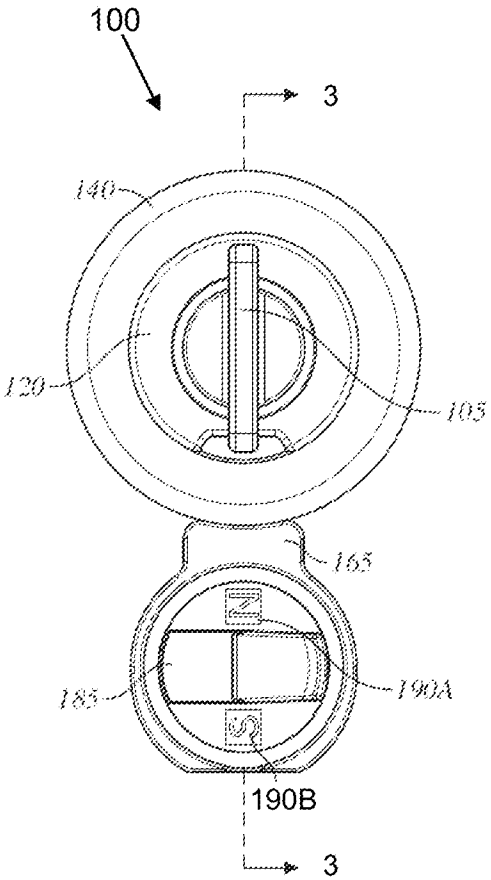

FIG. 2 shows a top view of the improved beverage container assembly 100 with the main container 140 integral with auxiliary container assembly 160. FIG. 3 shows a side view of the improved beverage container assembly 100 with the main container 140 integral with auxiliary container assembly. FIG. 3, shows an accessory compartment 170A to place various contents that may be included in one or more embodiments.

Figure 5:
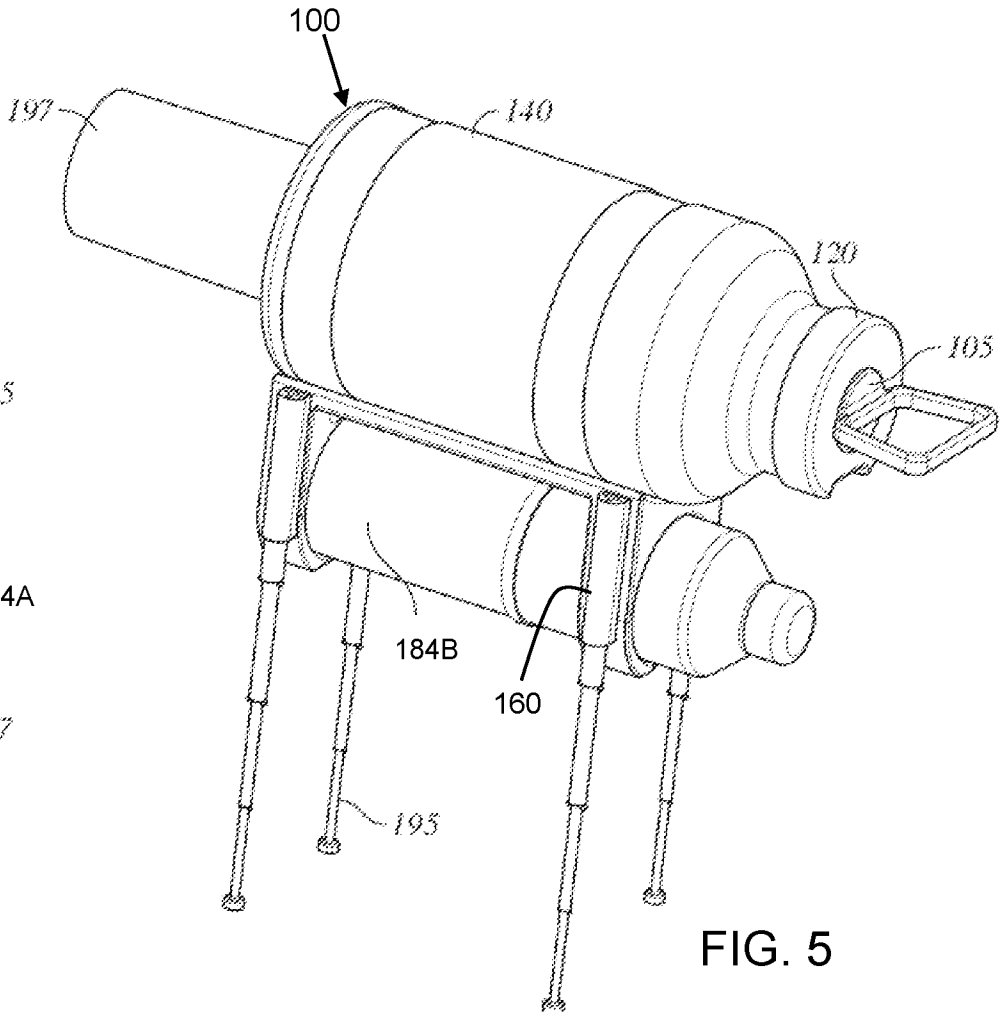
Figure 4:
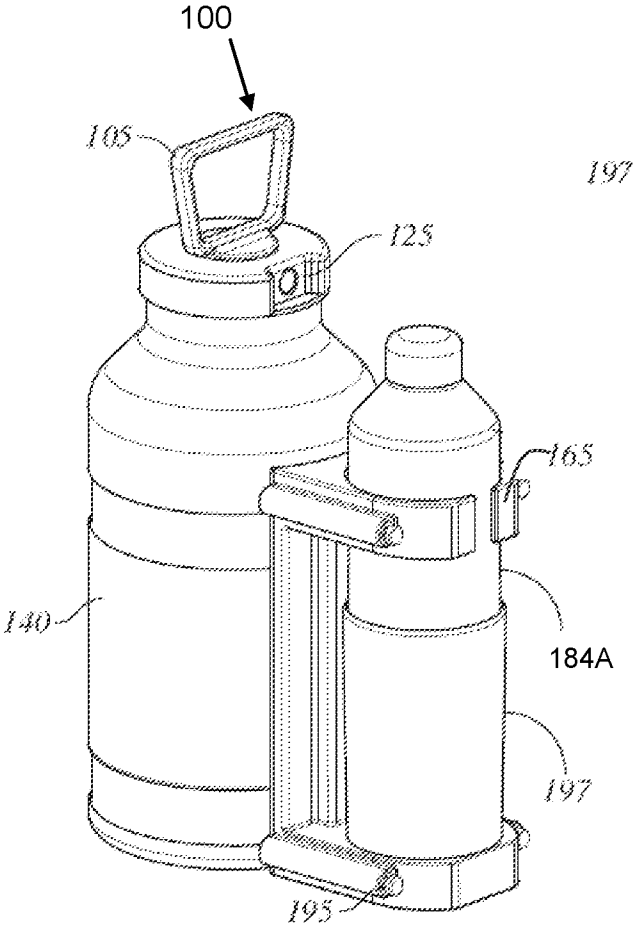
Figure 6:
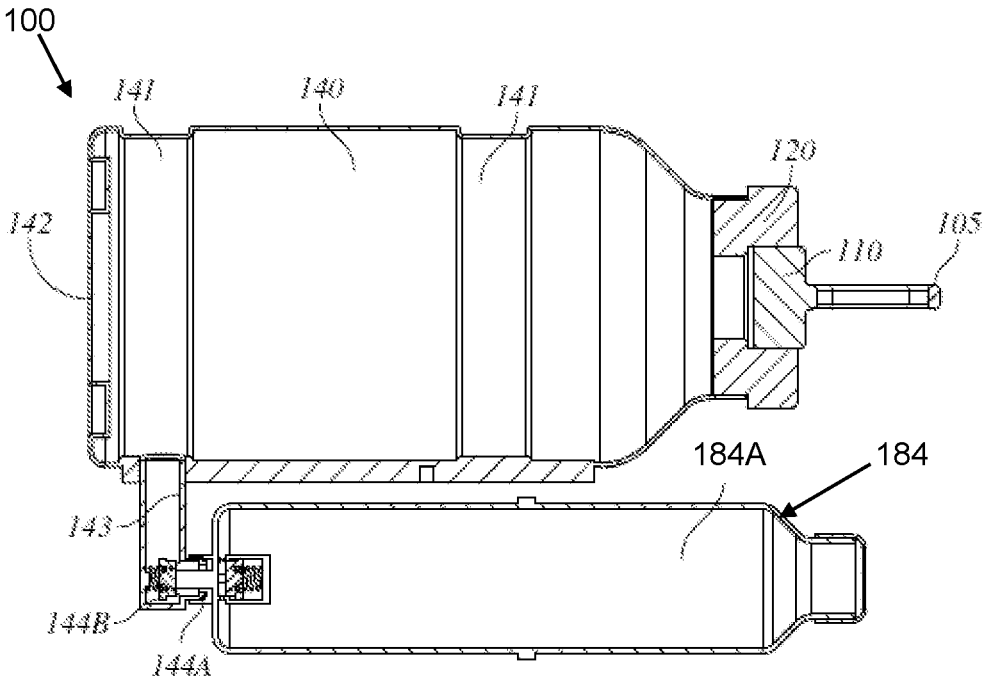
Figure 7:
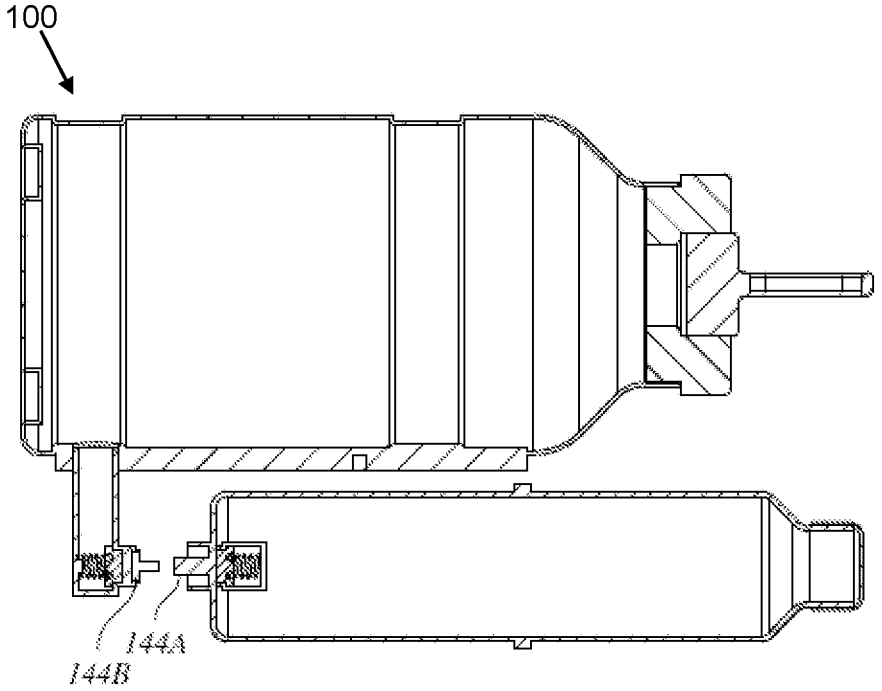

FIGS. 4 and 5 show perspective views of the improved beverage container assembly 100 in a transport mode and in a dispensing mode, respectively. In FIGS. 4 and 5, the improved beverage container assembly is shown with telescopic poles 195 attached to the auxiliary container assembly 160. Telescopic poles 195 may be configured as a self-locking ball and socket mechanism. In one or more embodiments, telescopic poles 195 may be configured as a plunger with spring-loaded mechanism. More specifically, the telescopic poles may be configured as a push rod connected in pivotal retained relation to a member such as the auxiliary container assembly 160 by an insert. The insert is fitted on the spherical ball end of the push rod and the insert with the push rod is then inserted into a recess in the member. The insert has a plurality of arms extending from the insert base end at a slight angle outwardly relative to the insert axis. The arms and the member recess are provided with various cam surfaces which force the arms inwardly in cantilever fashion during the insertion movement, and the arms have surfaces on their outer ends which fit within an annular groove in the cylindrical side wall of the member recess, locking the insert to the rod spherical ball end and also within the member recess.

FIGS. 4, and 5 show an embodiment of a small container assembly 184 having a first small container 184A. FIGS. 4 and 5, show an auxiliary cup. The Auxiliary cup 197 can be used for collecting beverage from large container or if attached underneath the large container may enable it to be securely positioned in the car cup holder. Auxiliary cup 197 can be attached by means of thread, magnet and the likeness thereof to the improved beverage container assembly 100.

Figure 8:
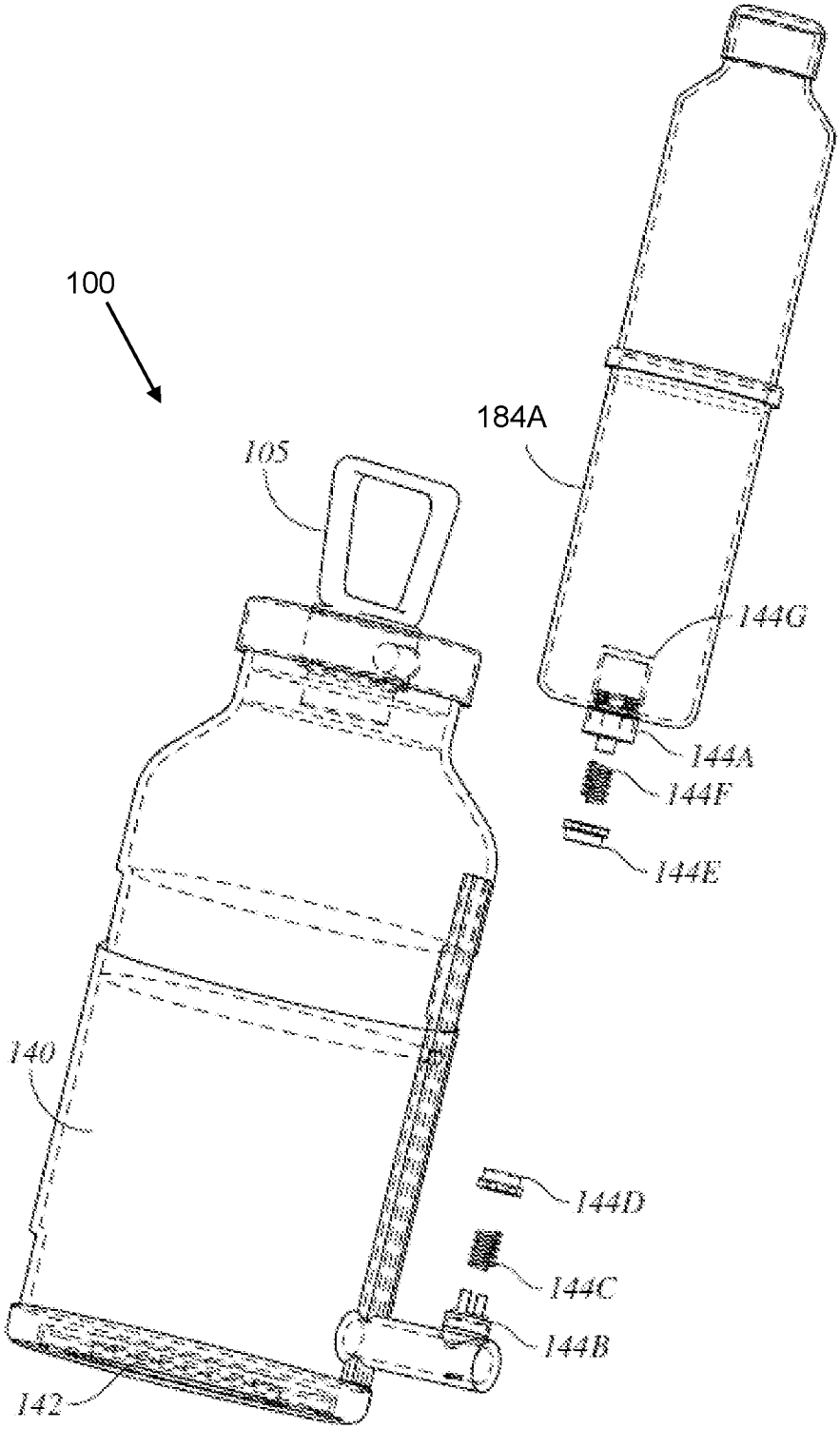

FIGS. 6, 7, 8 and 9 show cross sectional and perspective views of the improved beverage container assembly 100 comprising a large container base 142. The large container base 142 may be attached to the main container 140 via means of thread, press fit, magnet and the likeness thereof; a straight adapter 143, wherein the straight adapter 143 may connect to small container assembly 184 via an auto valve mechanism; an auto valve mechanism comprising a single pin valve 144A configured to push the diaphragm to open the valve, a dual pin valve 144B which pushes the diaphragm to open the valve, a compression spring 144C for the dual pin valve 144B configured to keep the diaphragm in position, provide retraction force to seal the diaphragm thereby closing the circuit, and wherein when external force is applied to compresses the spring, unseal the diaphragm thereby opening the circuit; a diaphragm 144D for the dual pin valve 144B configured to seal or unseal the valve to allow beverage intake or dispensation; a diaphragm 144E for the single pin valve 144A configured to seal or unseal the valve to allow beverage intake or dispensation; a compression spring 144F for the single pin valve 144 configured to keep the diaphragm in position, provide retraction force to seal the diaphragm thereby closing the circuit, and wherein when external force is applied to compresses the spring, unseal the diaphragm thereby opening the circuit; a valve housing 144G configured to hold the compression spring and diaphragm in place; and a connector channel 147. FIGS. 8 and 9 shows an embodiment of a small container. Regarding FIGS. 6, 7, 8 and 9 compression springs and diaphragms shown could be of equal or varying sizes. Valves could be interchangeable from large container to small container or vice versa. Single or multiple pins could be used on each valve. Essential functionality required is that opening valves allows beverage to flow from one container to the other without leaking. The flow rate of the beverage may depend on the position of the beverage system and the containers.

Figure 13:
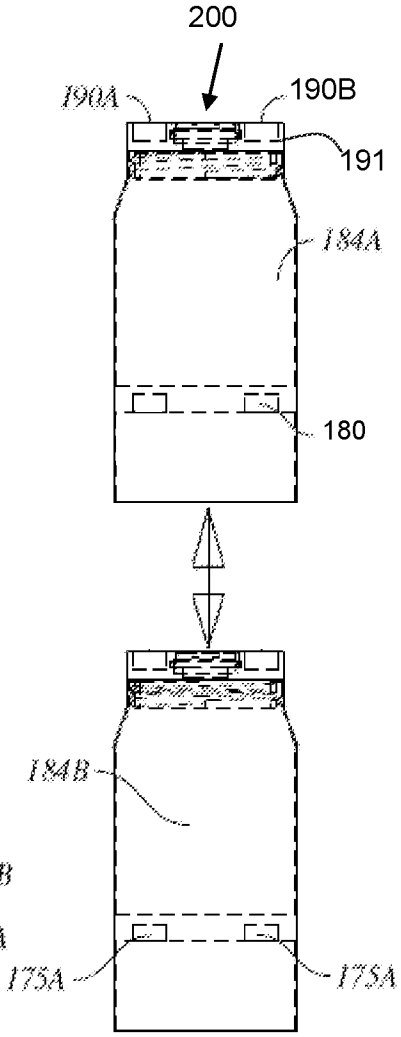
FIGS. 10, 11, 12, 13, 14, 15, 16, 17 and 18 show depictions of exemplary embodiments of the present disclosure.
Figure 12:
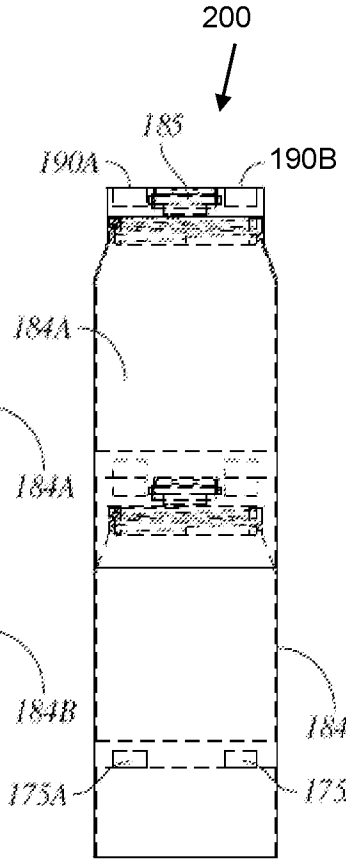
Figure 11:
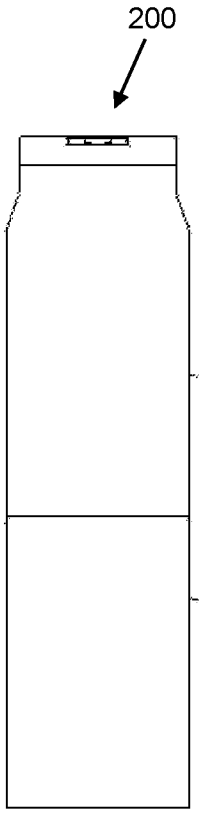
Figure 10:
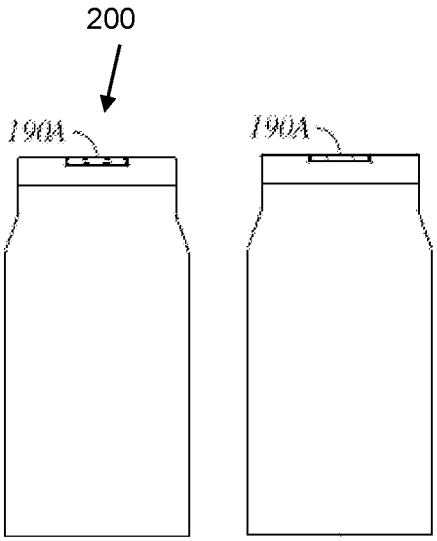
Figure 14:
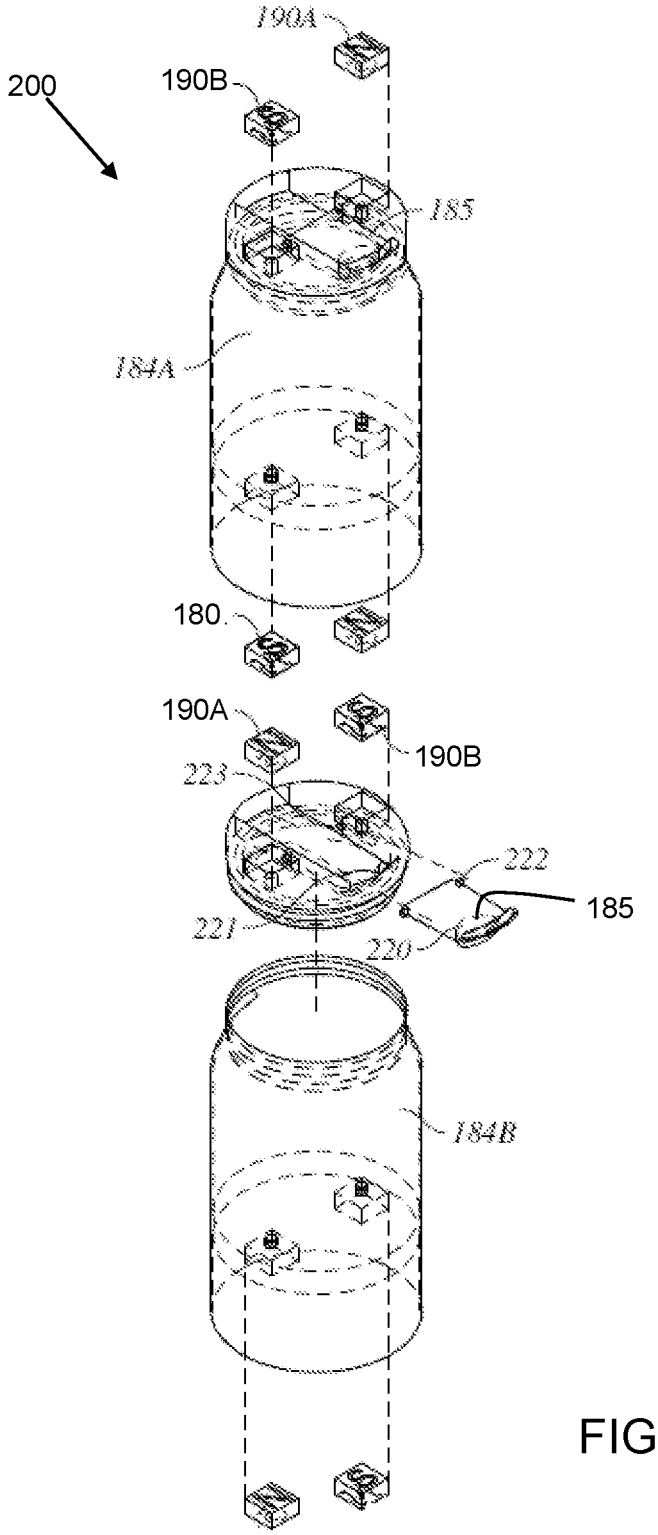
Figure 15:
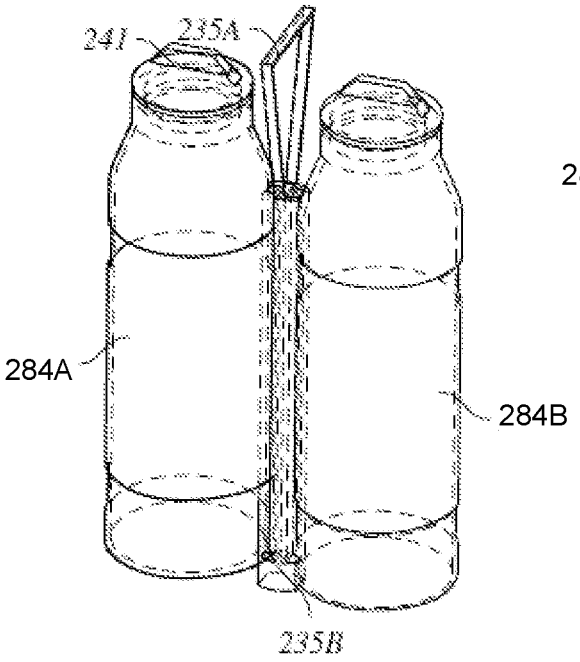
Figure 16:
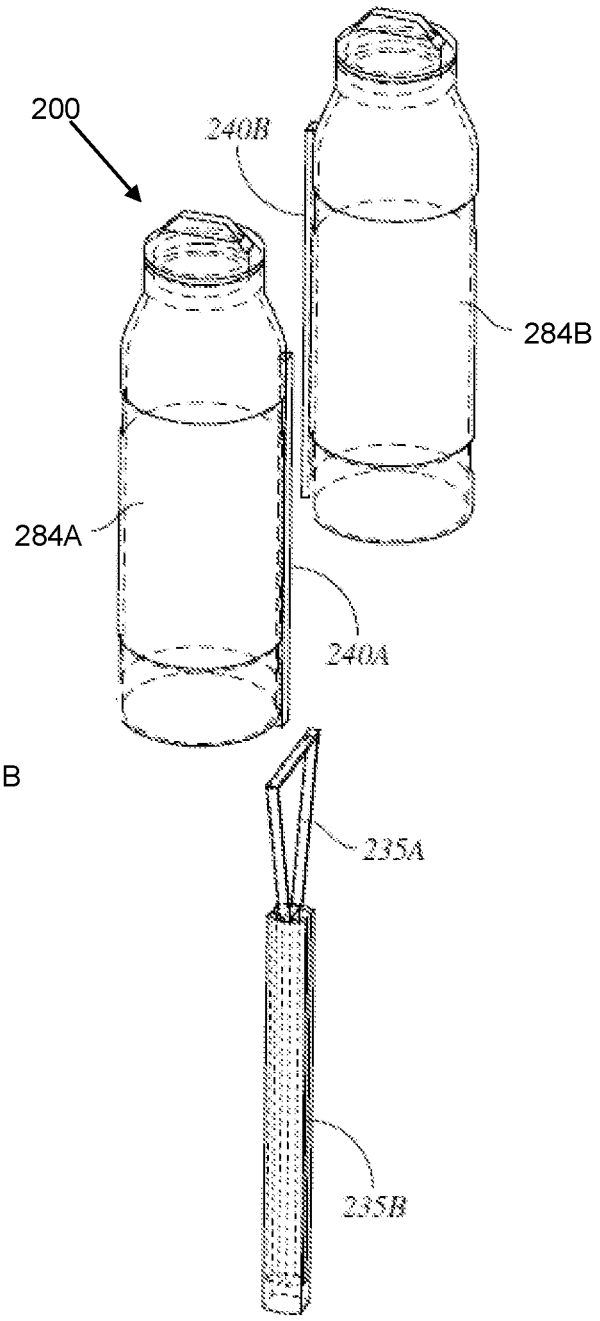

FIGS. 10, 11, 12, 13, 14, 15, 16, 17 and 18 show a depiction of an improved beverage container assembly in accordance with an exemplary embodiment of the present disclosure. More specifically, FIGS. 10, 11, 12, 13, 14, 15, 16, 17 and 18 show details of an improved beverage container assembly as it relates to container assembly 200. With respect to the first container 184A and second container 184B, interlocking magnetic connection, there are at least a pair of container lid magnets 190A positioned such that the magnetic pole orientation is opposite which enables holding larger load in an axial direction while rotating along that axis with simple torsion causes the magnetic force to release and the first container 184A and second container 184B to detach. As aforementioned, at least one magnet pole orientation is south and while the other magnet pole orientation is north on container lid. Container lid 191 with magnet poles 190A, 190B may be manufactured integrally by at least one of vacuum insulated technology, blow molding, insert molding, injection molding, or other fabrication method. In one or more embodiments, the magnet poles may be attached to lid 191 by means including but not limited to: adhesive means, welding means, screws, or other mechanical fastening means. The magnets 190A on first container 184A and second container 184B may be the same size or different sizes. They may also be configured to be any shape including but not limited to circular, square and rectangular. The same pole orientation may be on the container base. In one or more embodiments, the same manufacturing means and methods may be used on the container base. FIGS. 13 and 14 show an attachment position wherein magnetic poles are opposite magnetic north-south and magnetic south-north (NS-SN) between Container base and container lid they attract and securely attach first container 184A with second container 184B and looks like one small container assembly 184. FIGS. 13 and 14, show a detachment Motion as indicated by the large double arrow line between the containers. This describes a detachment position wherein magnetic poles are rotated with simple torsion such that orientation of magnets is same or like poles facing magnetic north-north and magnetic south-south (NN-SS) between container base and container lid causing them to repel and detach first container 184A from second container 184B producing two different and separate containers.

FIGS. 14, 15, 16, 17 and 18 show detailed features and components of an improved beverage container assembly as it relates to container assembly. The improved beverage container assembly comprising: a flip lid seal or protrusion 220 configured to seal or cap an aperture; a flip lid aperture 221 configured to allow for dispensing of beverage; a flip lid swivel mount 222 configured to allow the flip lid 185 to swivel; a flip lid swivel hole 223 configured to allow mounting of the flip lid swivel mount 222; a side connector handle 235A configured to carry the small container assembly 184 and auxiliary cup 197 securely; a side connector 235B, wherein in one or more embodiment, side connector 235B may be configured to engage integral connector 240B, wherein in one or more embodiment, integral connector 240A may be configured as side connector.

Figure 17:
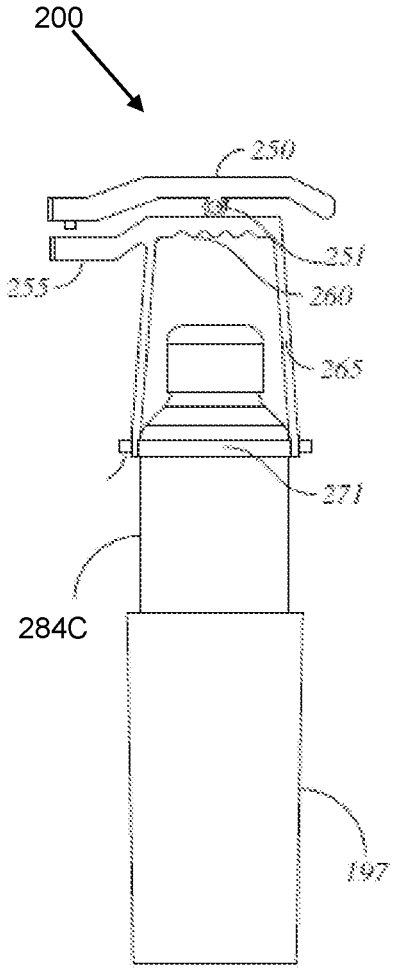
Figure 18:
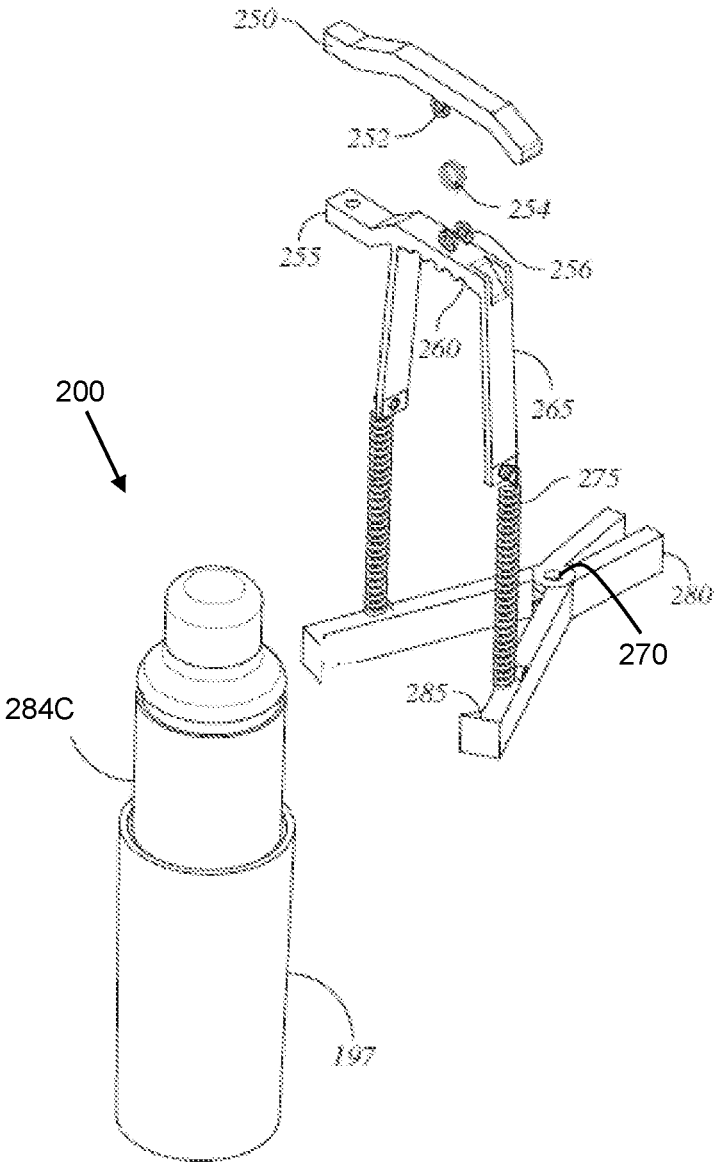
Figure 19:
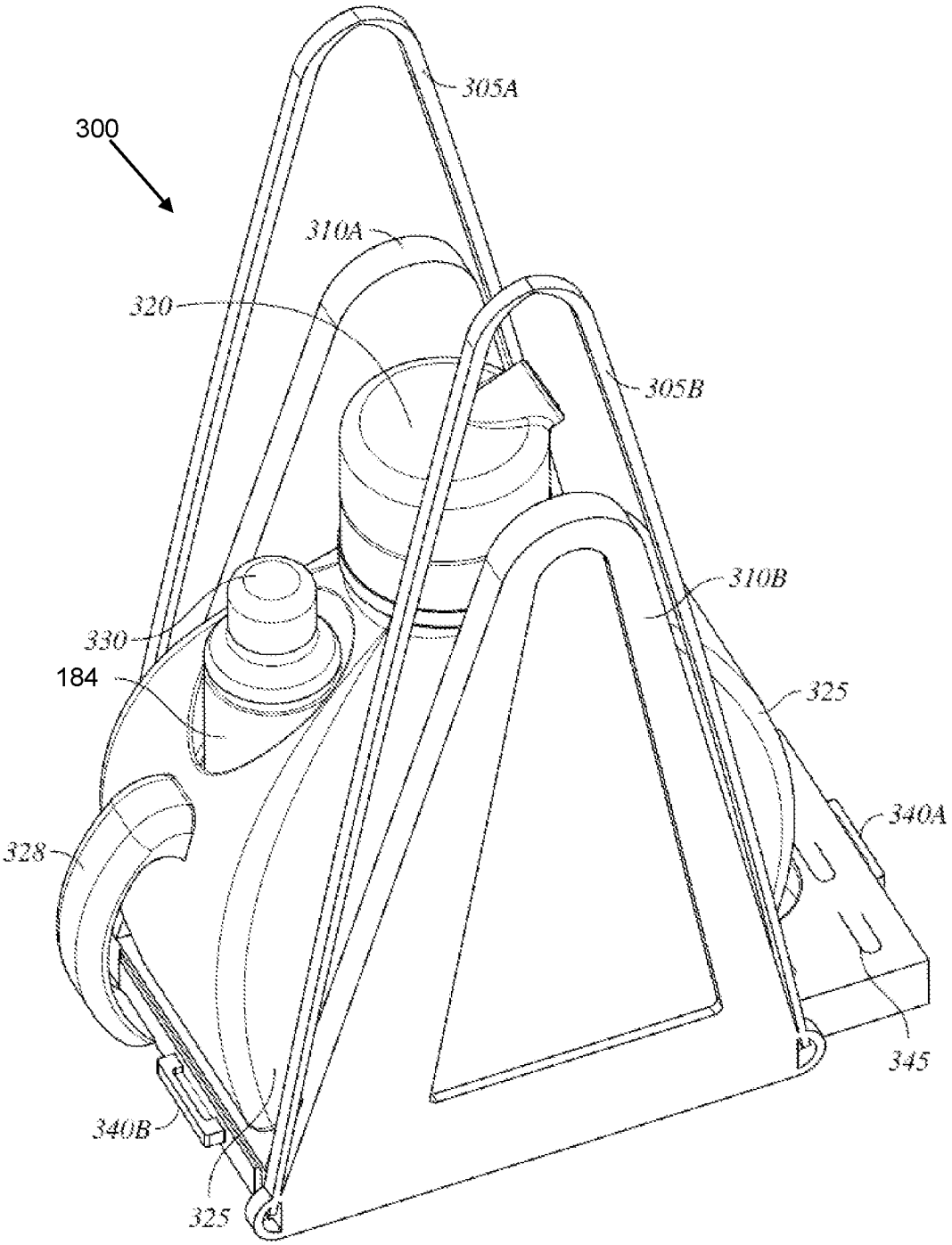
FIGS. 19 and 20 show depictions of a beverage container assembly in accordance with an exemplary embodiment of the present disclosure.
Figure 20:
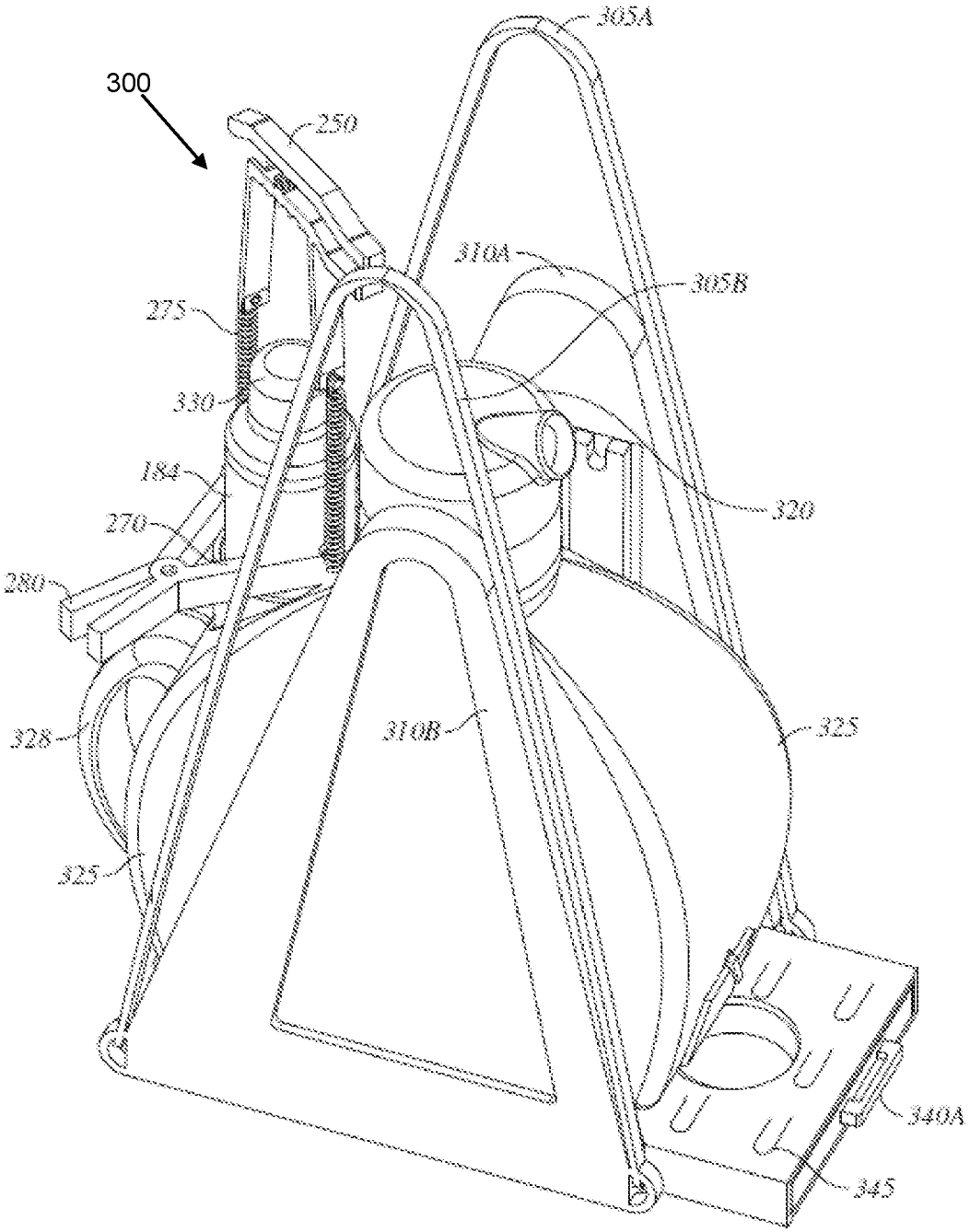
Figure 21:
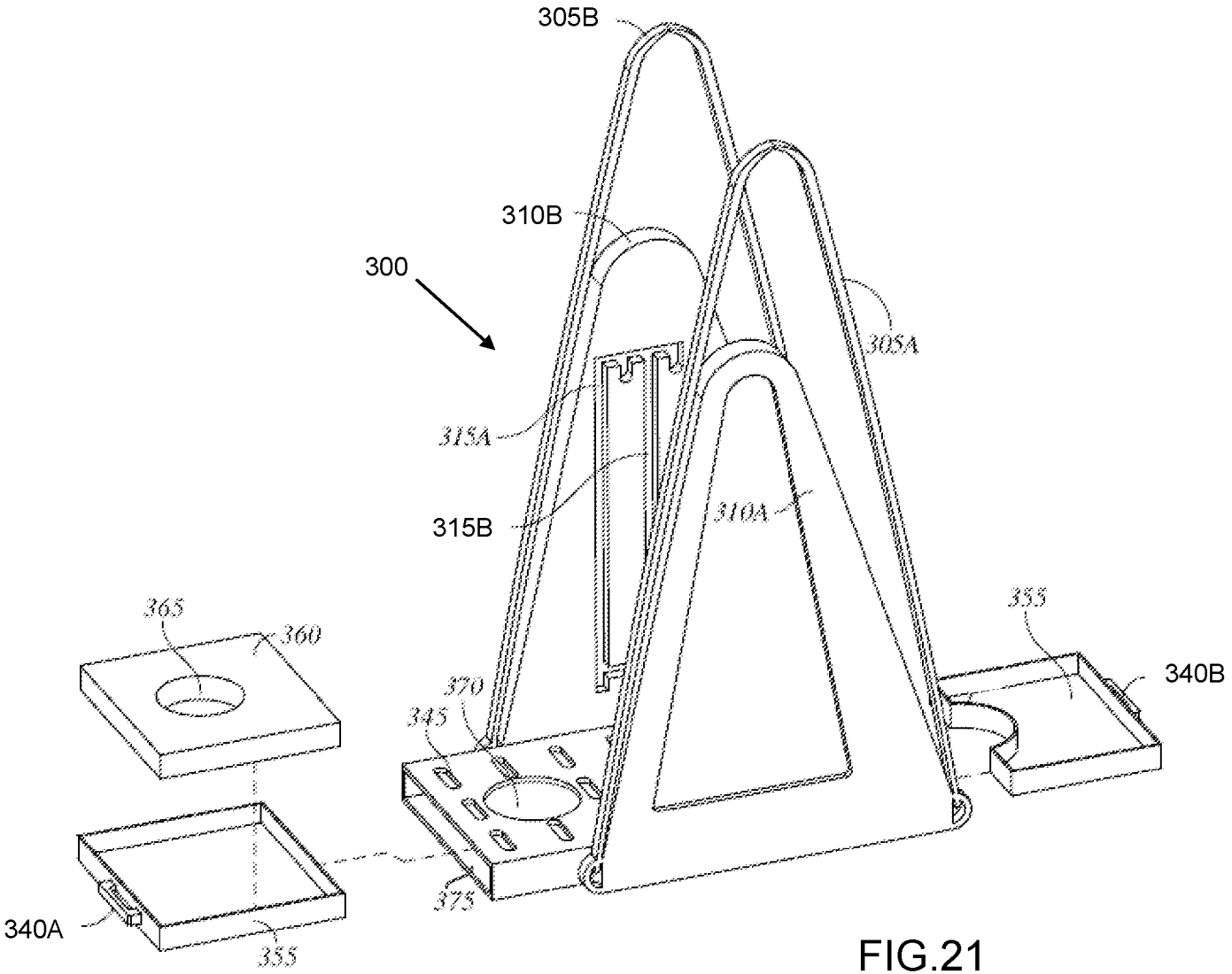
FIG. 21 shows a depiction of a beverage container assembly in accordance with an exemplary embodiment of the present disclosure.
Figure 22:
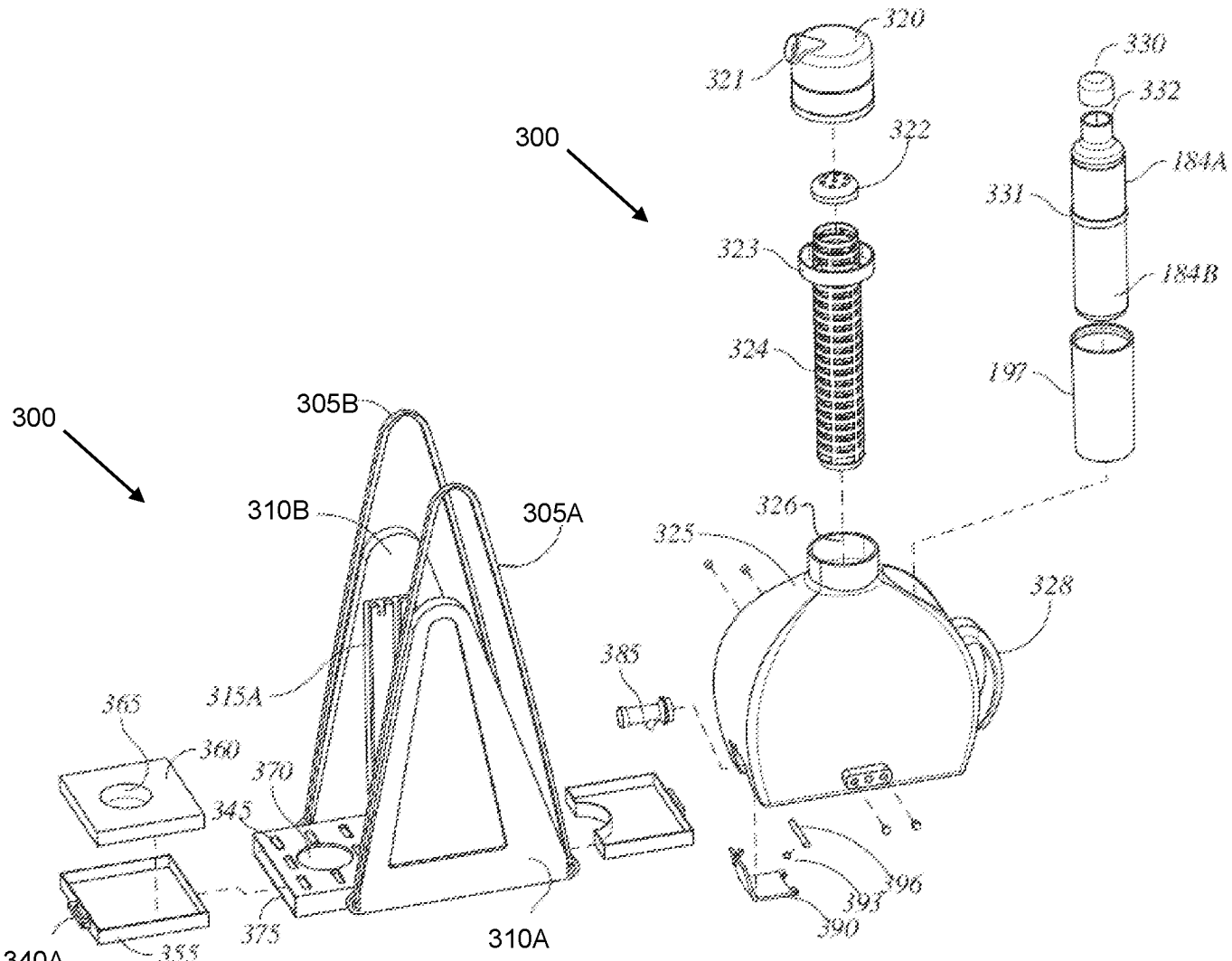
FIG. 22 shows a depiction of an exploded view of a beverage container assembly in accordance with an exemplary embodiment of the present disclosure.

Moreover, FIGS. 14, 15, 16, 17 and 18 show of an improved beverage container assembly as it relates to container assembly comprising: a lid without handle 241 wherein the simple lid without handle acts as a cap for the containers 284A, 284B; a clip moving side 250 configured to be a flexible side operable to move up and down and hinged at a pivot point; a pivot pin 251 (not explicitly shown in the FIGS. 15 to 18) configured to lock or keep in position the torsion spring; a clip moving side pivot 252 wherein the hinge connects with the handle; a clip torsion spring 254 wherein the clip torsion spring 254 applies retraction force and keep clip handle together to securely hold any objects; a handle or clip fixed side 255 configured to be a fixed side operable to move up and down and hinged at a pivot point; a handle pivot 256 configured at hinge to connect with clip moving side; finger grips 260 configured to allow for fingers to grip entire small container assembly securely; a handle or clip swivel side 265 configured to allow entire handle to swivel around clip swivel hinge 270; handle or clip swivel hinge 270 configured to securely hold the handle with the small container; a disk 271 surrounding the small container assembly 184 and configured to allow the handle to freely rotate 360 degrees of relative motion in both clockwise and counter clockwise directions; extension springs 275 constructed from flexible material made of plastic, metal or the likeness thereof configured to allow flexibility to move the small container assembly without having the need to remove the clip; a clip actuating side 280 configured to allow clip to hold and actuate thereby engage or disengage clip load holding side 285 to hold and/or release small container; and a clip load holding side 285 configured to hold objects and/or the small container assembly. FIG. 17, FIG. 18, shows an embodiment of small containers 284A and 284B. FIG. 17, FIG. 18 shows an embodiment of an auxiliary cup 197.

FIGS. 20, 21, 22, 23, 24, 25, 26, 27, 28, 29, 30, 31 and 32 show a depiction of an improved beverage container assembly in accordance with an exemplary embodiment of the present disclosure. More specifically, FIGS. 20, 21, 22, 23, 24, 25, 26, 27, 28, 29, 30, 31, and 32 show details of an improved beverage container assembly as it relates to improved beverage container assembly 300. The improved beverage container assembly 100 and 100 comprising: a left handle 305A configured to carry the entire improved beverage container system or frame wherein the frame includes a shell of the system when the containers are absent; a right handle 305B configured to carry the entire improved beverage container system or frame wherein the frame includes a shell of the system when the containers are absent; a left frame support 310A configured to securely hold the container in place; a right frame support 310B configured to securely hold the container in place; guide slots 315A, 315B are configured to guide rollers 382A that are attached to large container 325; a large container cap 320 configured to cap the beverage and allow for dispensing from large container cap aperture 321; large container cap aperture 321 configured to allow fluid or beverage dispensing; a basket cap 322 configured to cap the items in the basket; a basket connector 323 configured to allow connecting basket with large container by means of thread, press fit and the like; basket slots 324 configured to allow fusion of items in the basket to items in the large container 325; large container 325 configured to store, hold or transport beverage. main container configured to store, hold, or transport any beverage.

The size of the large container 325 includes but is not limited to 8 ounces, 16 ounces, 32 ounces, 64 ounces, 128 ounces larger. The shape of large container 325 includes but is not limited to circular, cylindrical, rectangular, trapezoidal, and other shapes. Large container 325 may be manufactured by at least one of vacuum insulated technology, blow molding, injection molding, or other fabrication method. The position of the small container assembly 184 within the large container 325 may be in one or more positions other than what is depicted.

Regarding FIGS. 20, 21, 22, 23, 24, 25, 26, 27, 28, 29, 30, 31, and 32, the improved beverage container assembly further comprising: a large container connector 326 configured to allow connection between large container 325 and basket connector 323; a large container handle 328 configured to allow for carrying large container 325; a small container cap 330 configured to cap the small container; an integral connector 331 for auxiliary cup wherein the integral connector is configured for securely attaching auxiliary cup. This integral connector 331 can be embedded in small container assembly 184 by means of thread, press fit, and the like. In other embodiments, integral connector 331 could be a separate component part; a small container mouth 332; a small container top portion 184A; a small container assembly 184; a small container bottom portion 184B; a small container compartment 338 configured as a recess to place small container assembly 184; draining beverage collection drawer handle 340A configured to allow back and forth motion of accessories compartment 355 to allow for removal of sponge 360 configured to soak up spilled liquid; accessories storage drawer handle 340B is configured to allow back and forth motion of drainage beverage collection drawer to allow for placement of contents; beverage draining slots 345 configured to allow waste beverage to pass thru onto sponge 360 which is located in the draining beverage collection drawer; provision to accommodate auxiliary cap wherein the auxiliary cap may be attached underneath the frame base; accessories compartment 355; sponge 360; opening in sponge 365 for small container 365; opening in frame 370 for small container; opening in frame 375 for the accessories compartment 355; guide roller holder 380; guide roller 382A configured to allow for positioning large container in different modes including but not limited to for example, dispensing mode, storage mode and the like; faucet 385 configured to allow beverage to dispense; dust cover 390 configured to protect dust from entering the faucet 385; snap lock 392 configured to allow locking or securing dust cover 390 in closed condition; torsion spring 393 configured to enable retraction of the dust cover opening when not locked by snap lock 392; hinge 394 configured to allow securing hinge pin 396 with torsion spring 393 in one axis; and hinge pin 396 configured to allow movement of dust cover with respect to its axis.

Figure 23:
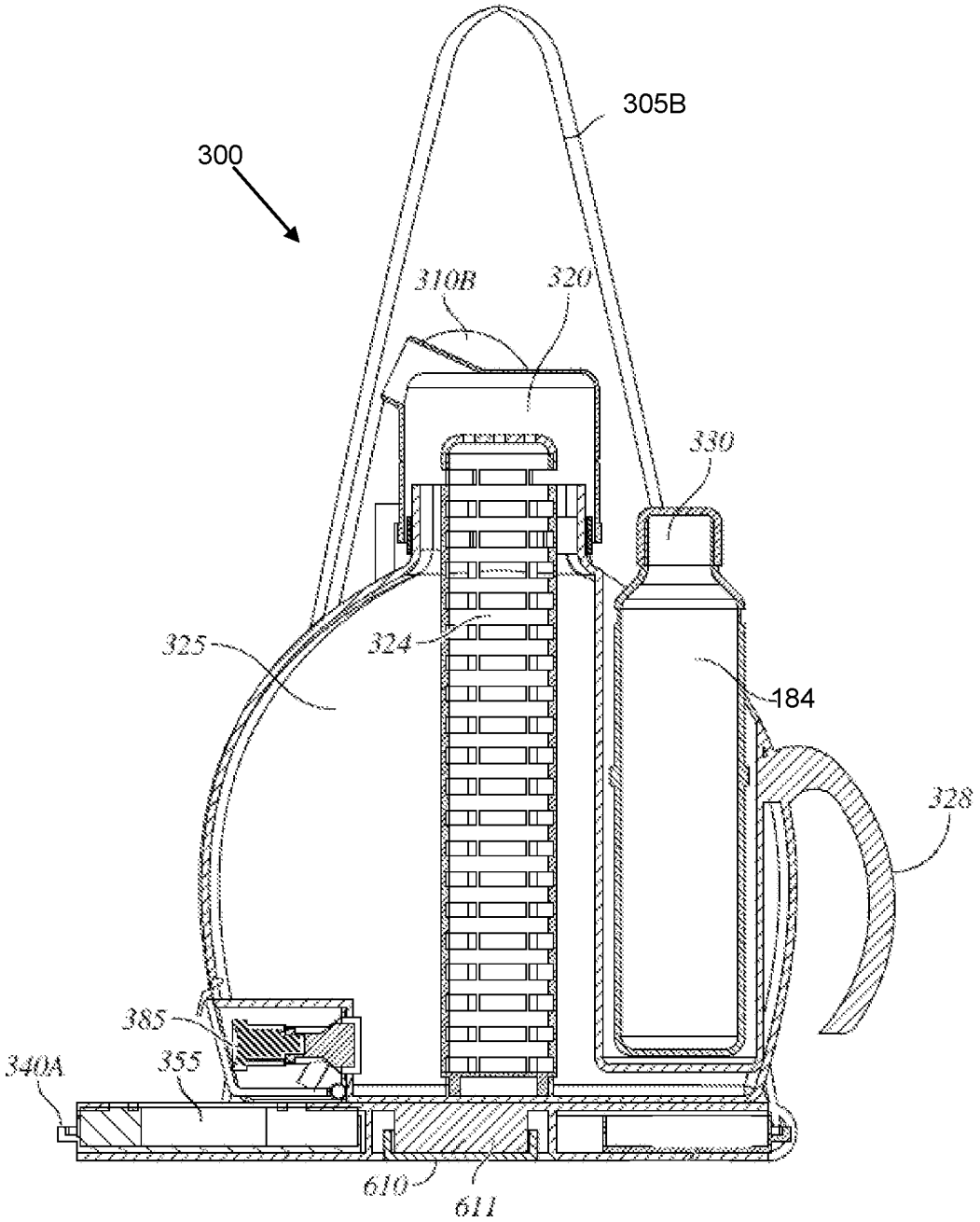
FIG. 23 shows a depiction of a cross-sectional view of a beverage container assembly in accordance with an exemplary embodiment of the present disclosure.
Figure 24:
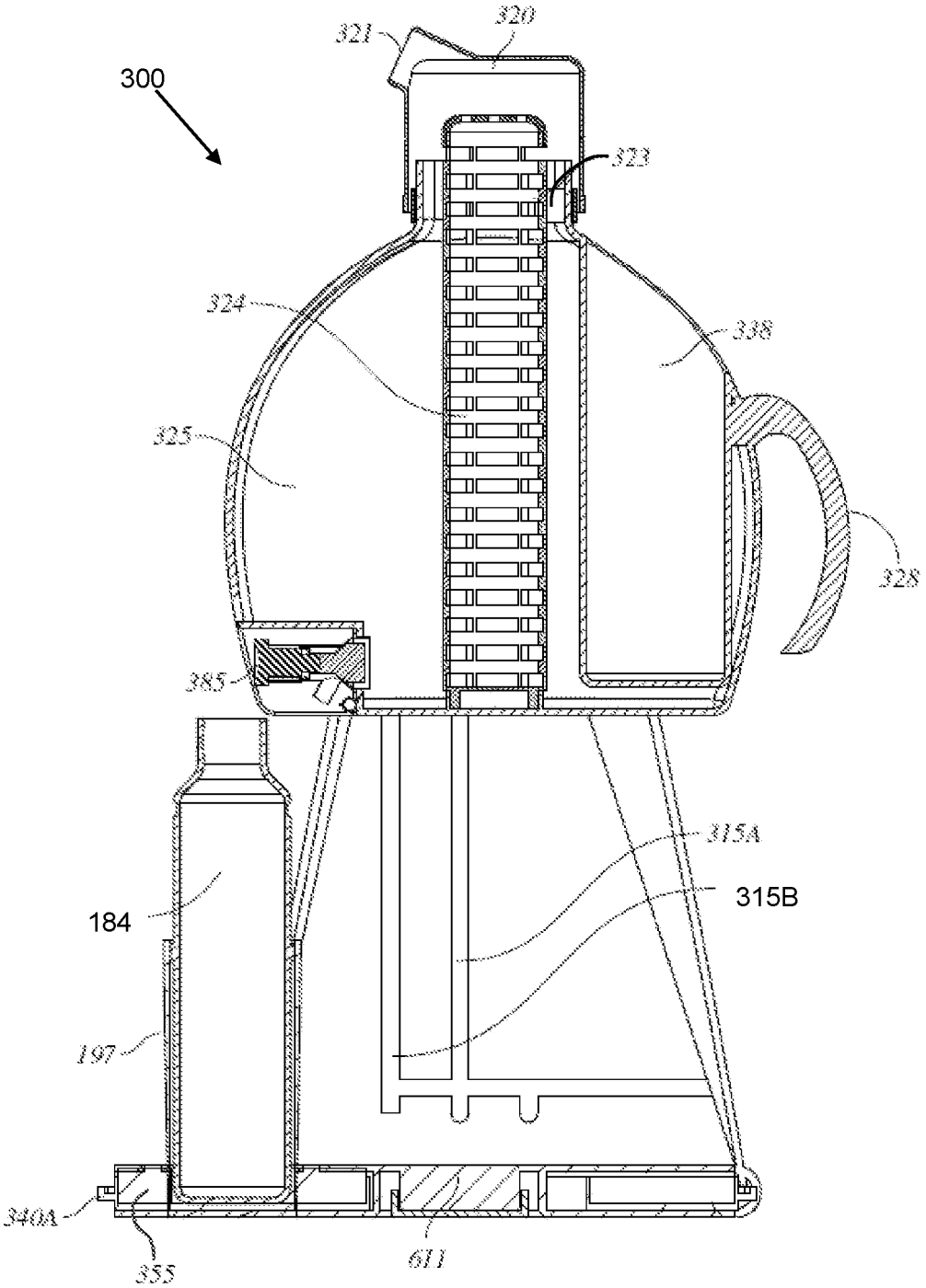
FIG. 24 shows a depiction of a cross-sectional view of a beverage container assembly in accordance with an exemplary embodiment of the present disclosure.
Figure 25:
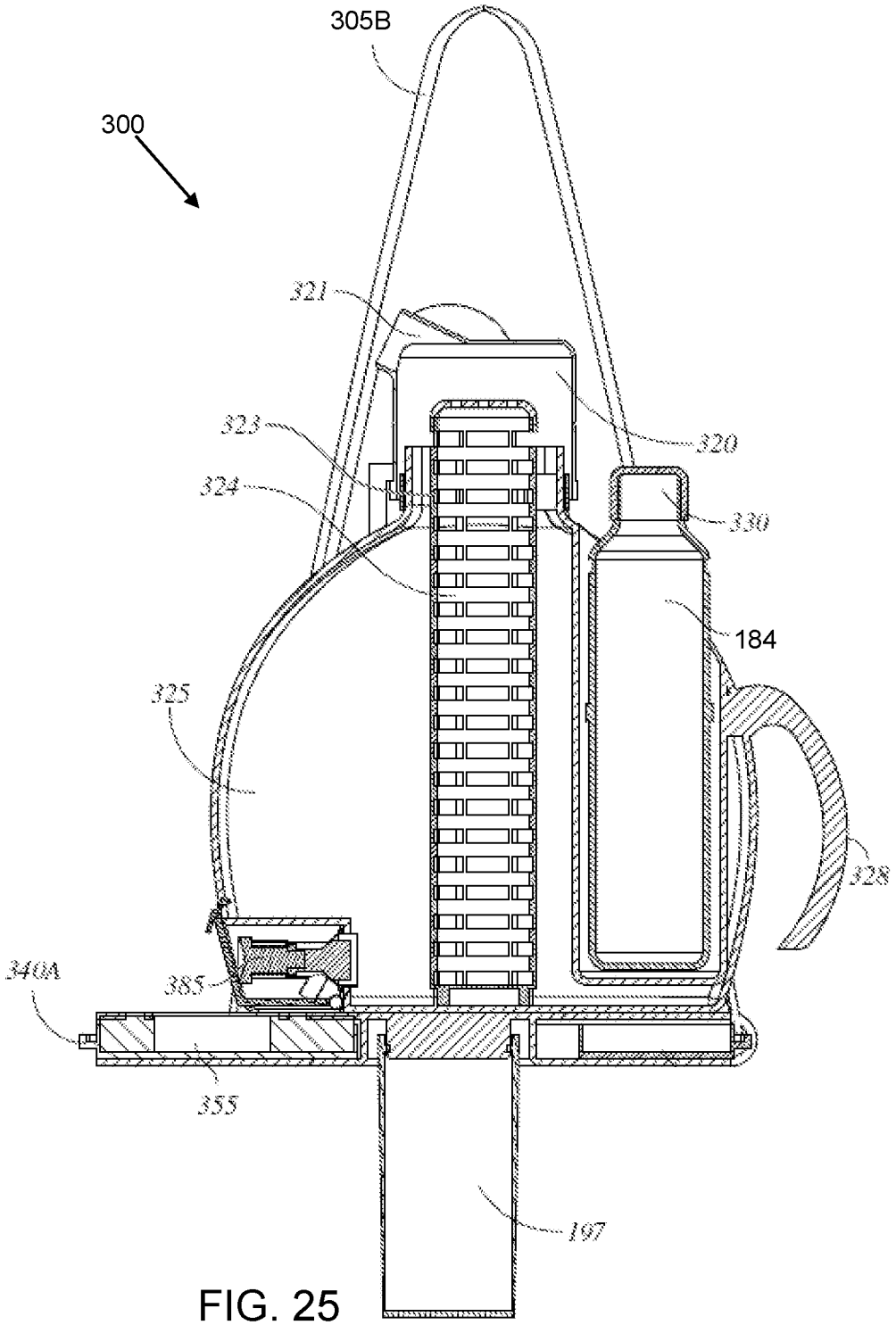
FIG. 25 shows a depiction of a cross-sectional view of a beverage container assembly in accordance with an exemplary embodiment of the present disclosure.
Figure 26:
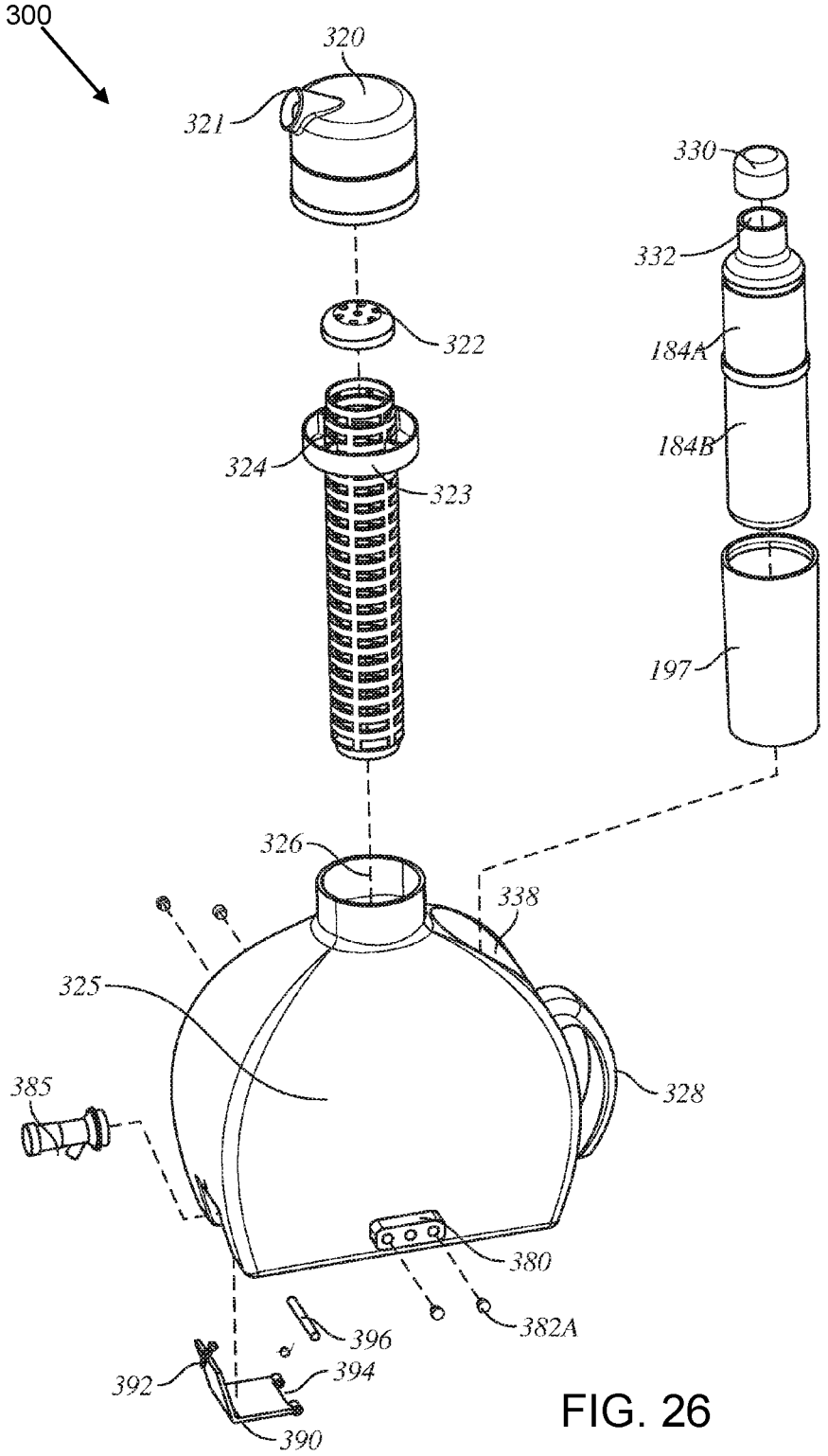
FIG. 26 shows a depiction of an exploded view of a beverage container assembly in accordance with an exemplary embodiment of the present disclosure.
Figure 28:
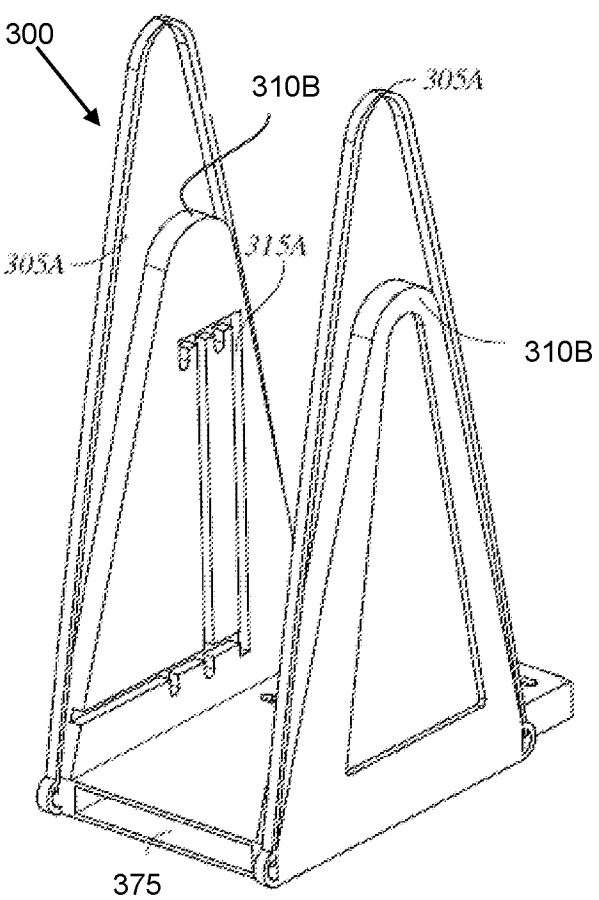
FIGS. 27 and 28 show a depictions of isometric views of a beverage container assembly in accordance with an exemplary embodiment of the present disclosure.
Figure 27:
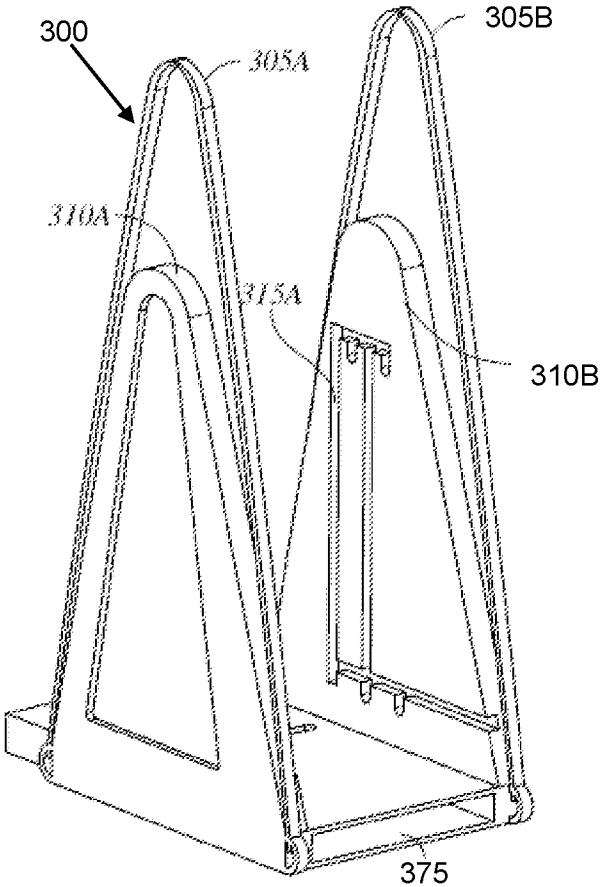

FIG. 23 shows an embodiment of the improved beverage container assembly 600 in transport mode. FIG. 23, shows an auxiliary cap holder 611. FIG. 23, shows an auxiliary cap 610. FIG. 24 shows an embodiment of the improved beverage container assembly 700 in dispensing mode. FIG. 24, shows an auxiliary cap holder 611. FIG. 26 shows an embodiment of the improved beverage container assembly 900. FIG. 26, shows auxiliary cup 197.

Figure 29:
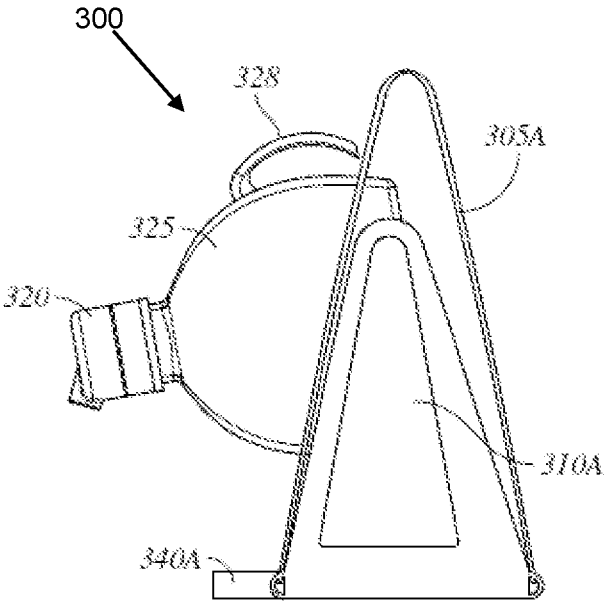
FIGS. 29, 30, 31 and 32 show a depiction of side views and rotated isometric views of a beverage container assembly in accordance with an exemplary embodiment of the present disclosure.
Figure 30:
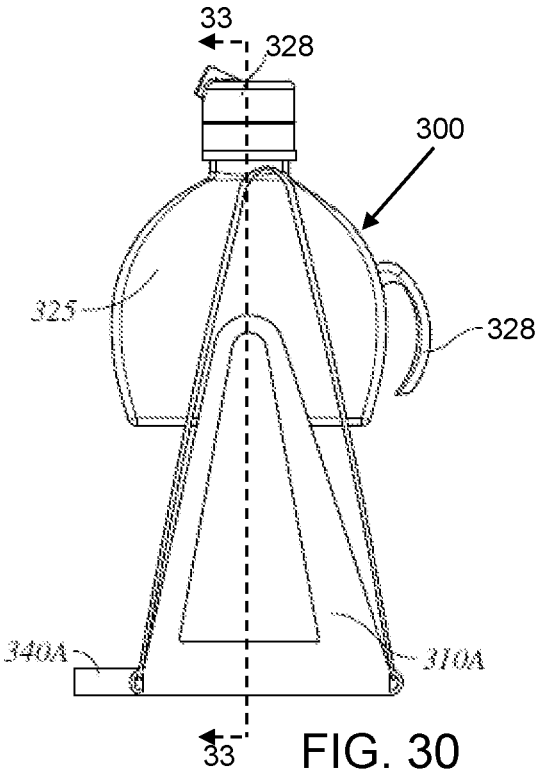
Figure 31:
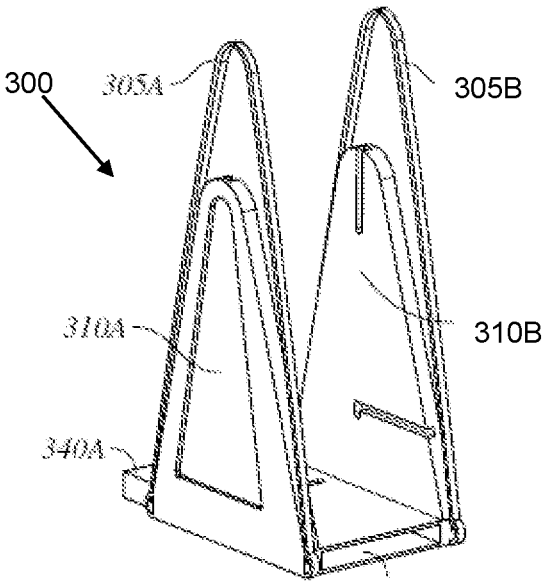
Figure 32:
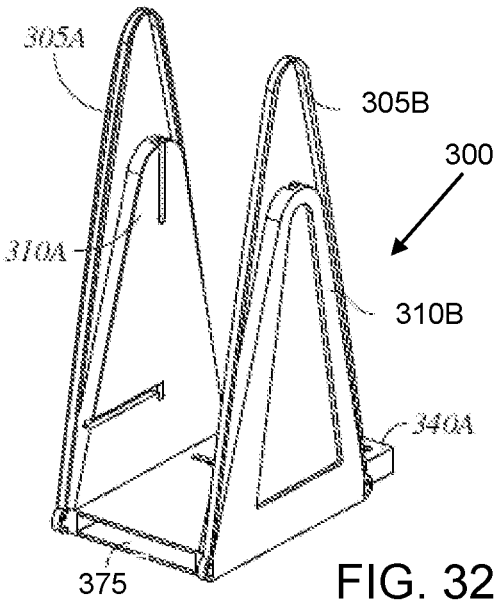

FIG. 29 shows an embodiment of the improved beverage container assembly 100 in a dispensing position operating mode. FIG. 30 shows an embodiment of the improved beverage container assembly 100 in an elevated position or operating mode. This elevated position is part of the dispensing position operating mode. FIGS. 31 and 32 and show an embodiment of the improved beverage container assembly 100.

Figure 33:
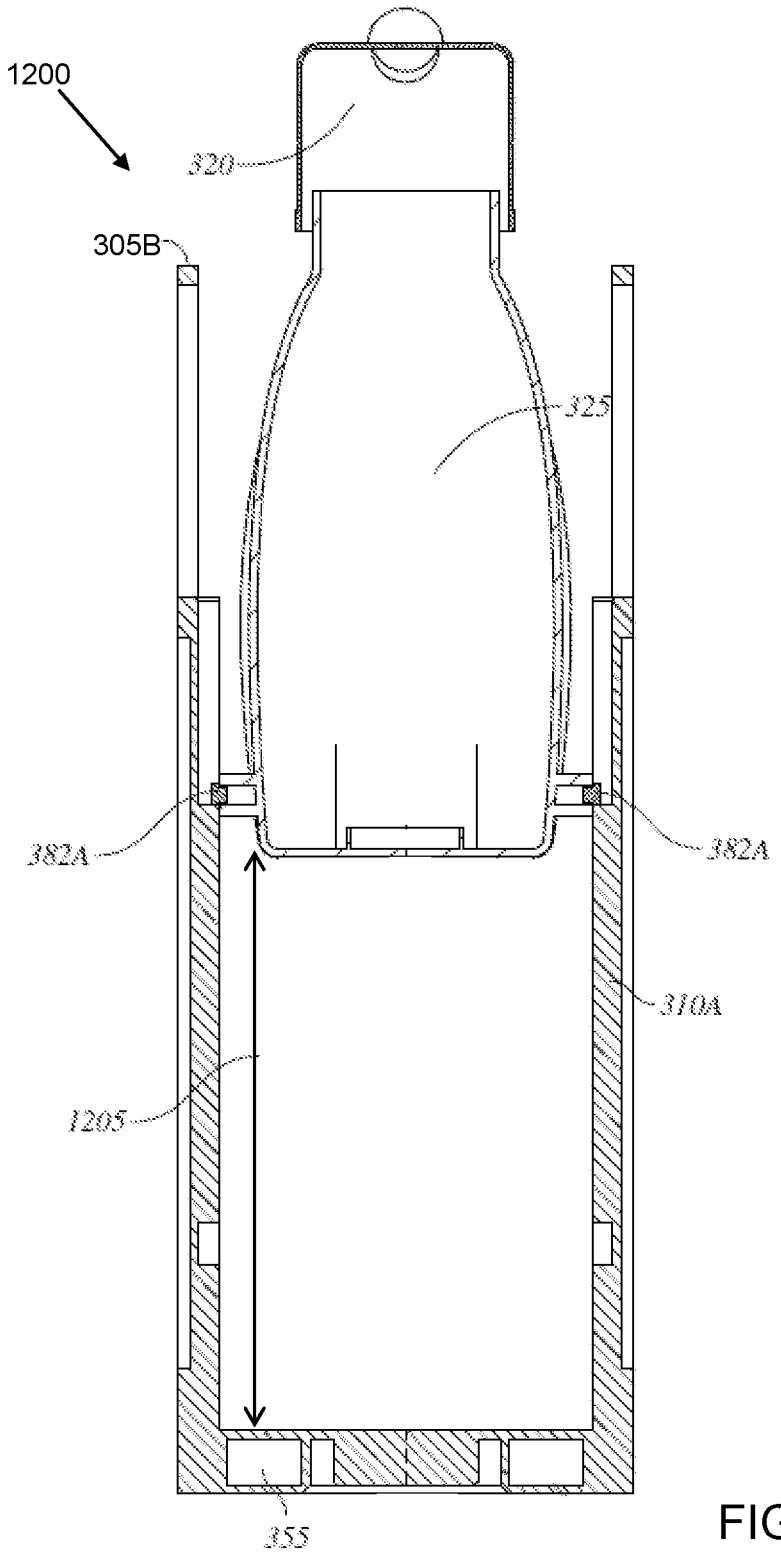
FIG. 33 shows a depiction of a cross-sectional view of a beverage container assembly in accordance with an exemplary embodiment of the present disclosure.

FIG. 33 shows a depiction of an improved beverage container assembly in accordance with an exemplary embodiment of the present disclosure. More specifically, FIG. 33 shows an embodiment of the improved beverage container assembly 1200 in an elevated position. The elevated position may also be referred to as a raised position. The elevated position may also be part of the dispensing position operating mode. FIG. 33, shows the dispensing height 1205 which allows the positioning of a large container in a dispensing mode. Guide roller 382A configured to allow for positioning large container in different modes including but not limited to for example, dispensing mode, storage mode.

Figure 34:
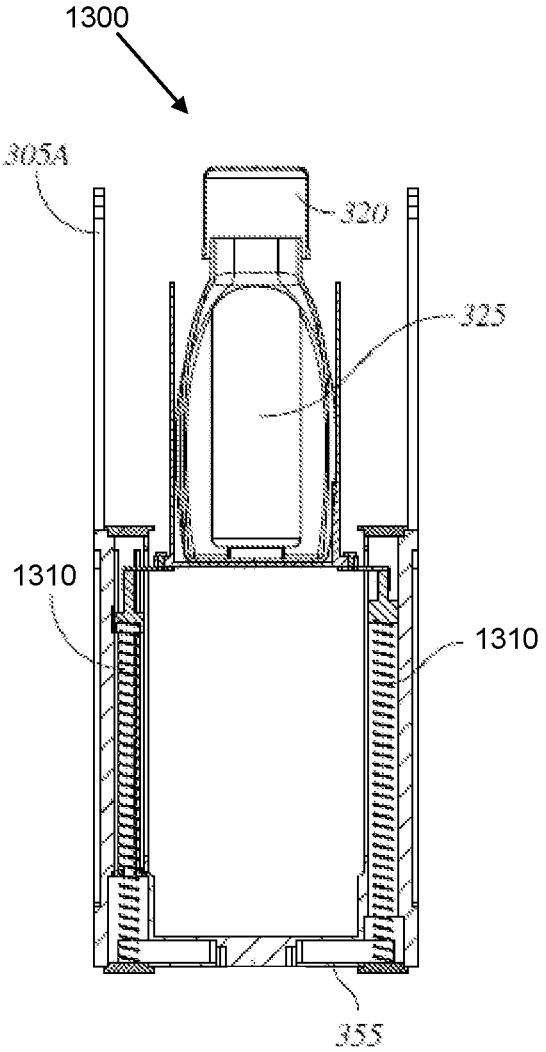
FIGS. 34 and 35 shows depictions of a cross-sectional view of a beverage container assembly in accordance with an exemplary embodiment of the present disclosure.
Figure 35:
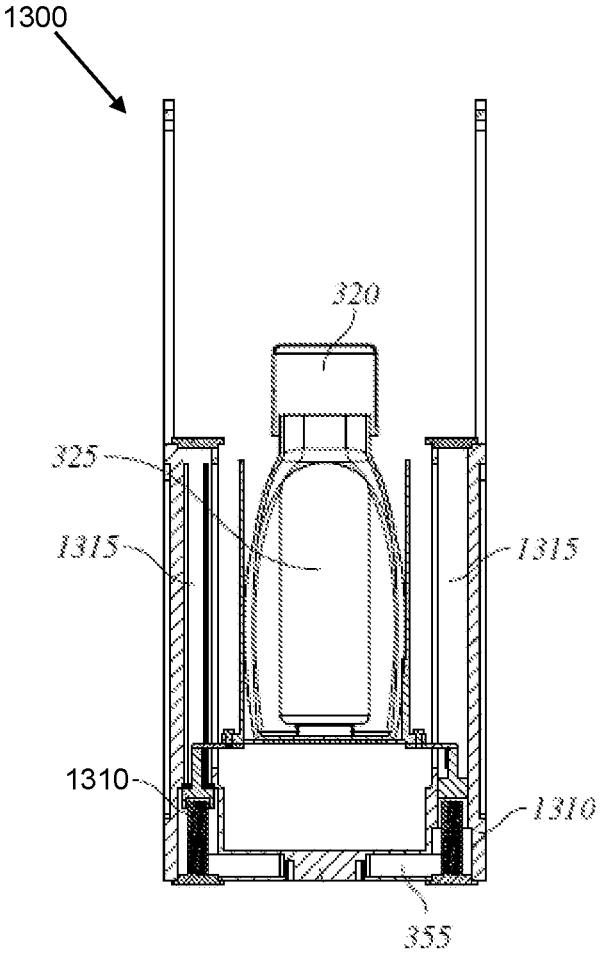

FIGS. 34 and 35 show a depiction of an improved beverage container assembly in accordance with an exemplary embodiment of the present disclosure. FIGS. 34 and 35 show the improved beverage container assembly comprising a spring assembly means configured to allow the improved beverage container assembly to move between various modes of operation. More specifically, FIG. 34 shows embodiment of the improved beverage container assembly 1300 in an elevated position. FIG. 34, shows the springs 1310 in retraction mode. Springs 1310 in retraction mode allows a large container to maintain an elevated position in a dispensing mode. FIG. 35 shows embodiment of the improved beverage container assembly 1300 in a compressed position. Springs 1310 in compression mode allow a large container to maintain a lowered position in a storage mode or transportation mode. FIG. 34, shows a cam guide ways column 1315. This column guides the cam with piston and without piston to securely provide a means for the mode of operation to be changed.

Figure 37:
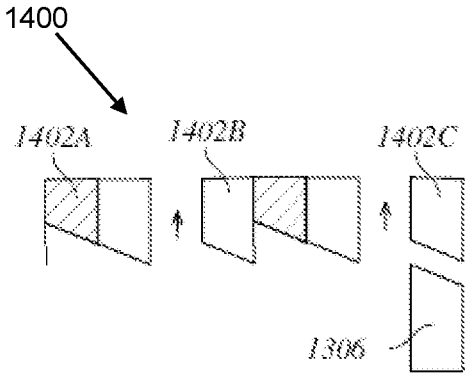
FIG. 37 shows a cam lock guideway.
Figure 36:
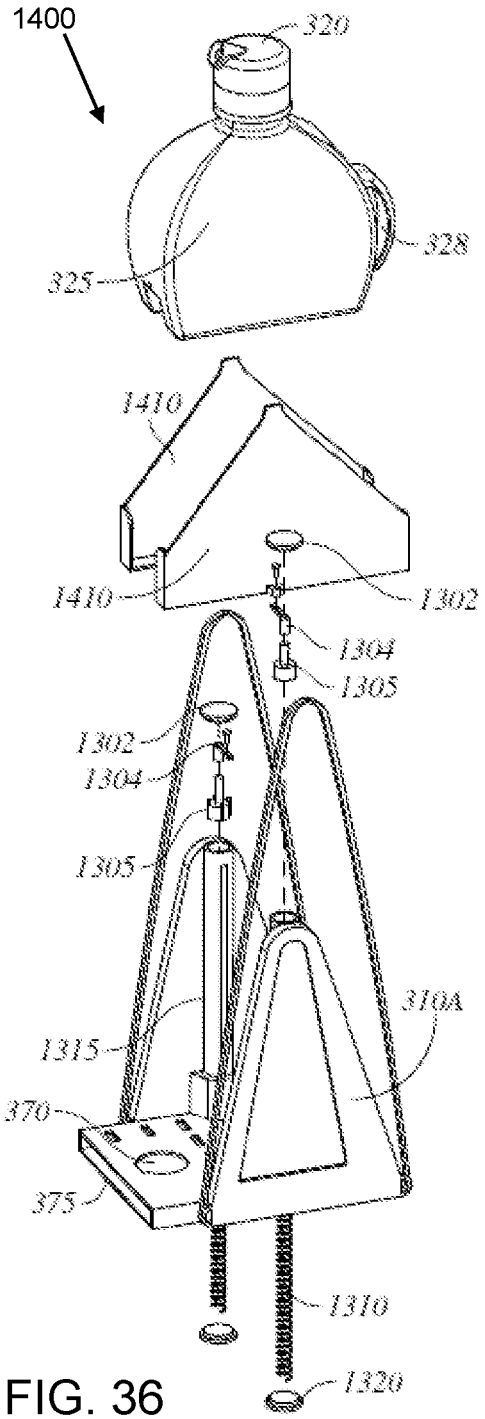
FIG. 36 shows an exploded view of a beverage container assembly in accordance with an exemplary embodiment of the present disclosure.

FIGS. 36 and 37 show a depiction of an improved beverage container assembly 1400 in accordance with an exemplary embodiment of the present disclosure. As shown in FIGS. 34, 35, 36 and 37, the improved beverage container assembly comprising a spring assembly means configured to allow the improved beverage container assembly to move between various modes of operation. FIG. 36 shows a connecting rode mounting screw configured to connect the large container holder 1410 with a piston 1305. In one or more embodiments, both columns may have pistons with cams. In one or more embodiments, multiple columns may be added. Multiple columns may have pistons with cams. The shape of the guide way includes but is not limited to square, rectangular, and trapezoidal. FIG. 36, shows a guide way column top cap 1302 wherein the column top cap is configured to prevent dust entering into the guide way column; FIG. 36, shows a connecting rod 1304 wherein the connecting rod is configured to connect a piston with a cam to the large container holder 1410 via screw 1301. In some embodiments, FIG. 36 shows a connecting rod wherein the connecting rod is configured to connect a piston without a cam to the large container holder 1410 via screw 1301. FIG. 36, and FIG. 37, show a piston without a cam 1306 wherein the piston is configured to balance the large container load. FIG. 36, shows a piston 1305 with a cam wherein the piston is configured to allow changing the mode of operation between a dispensing mode and a storage mode. FIG. 36 shows a guide way column 1315 configured to guide the piston with and without a cam. FIG. 36, shows compression springs 1310 configured to allow for the changes in operating modes. FIG. 36, shows a guide way column bottom cap 1320 wherein the cap is configured to prevent dust from entering the guide way column. FIG. 37 illustrates a cam lock guideway 1402A configured to prevent the cam from moving upwards. This functionality allows transport mode to be achieved. The springs 1310 remain compressed and the large container remains in a retracted position or transport position operating mode. FIG. 37 illustrates, a cam thru guide way 1402B configured to allow the cam to move upwards. This functionality allows dispensing mode to be achieved. The springs 1310 are uncompressed and the large container is positioned in a raised position allowing for dispensing. FIG. 37 illustrates a cam guide ways column 1402C configured to guide the piston with a cam and without a cam. FIG. 36 shows a large container holder 1410 configured to hold the large container securely in place.

Figure 40:
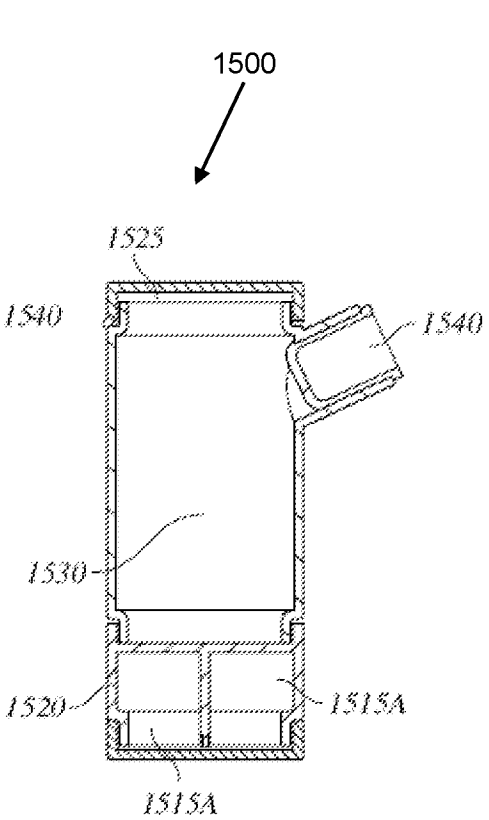
FIGS. 38, 39 and 40 show a depiction of an exploded view and cross-sectional views of a beverage container in accordance with an exemplary embodiment of the present disclosure.
Figure 39:
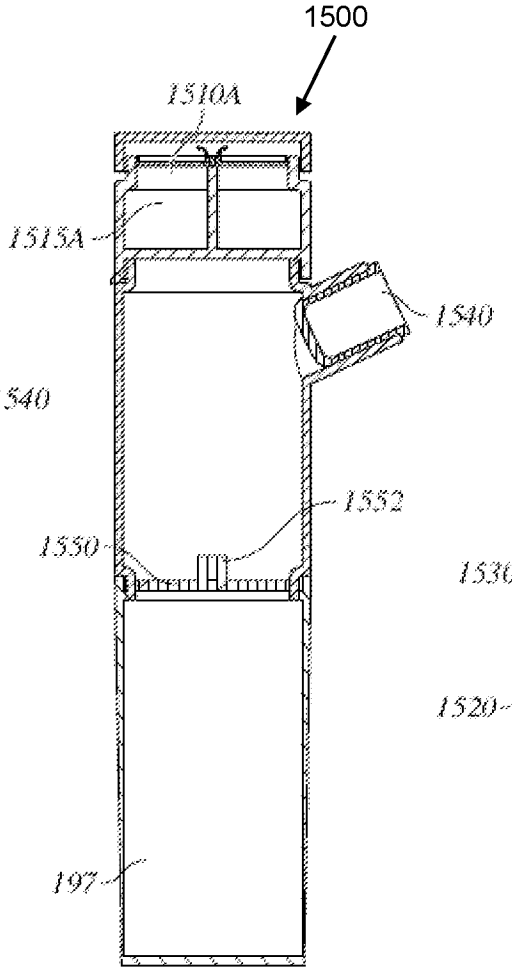
Figure 38:
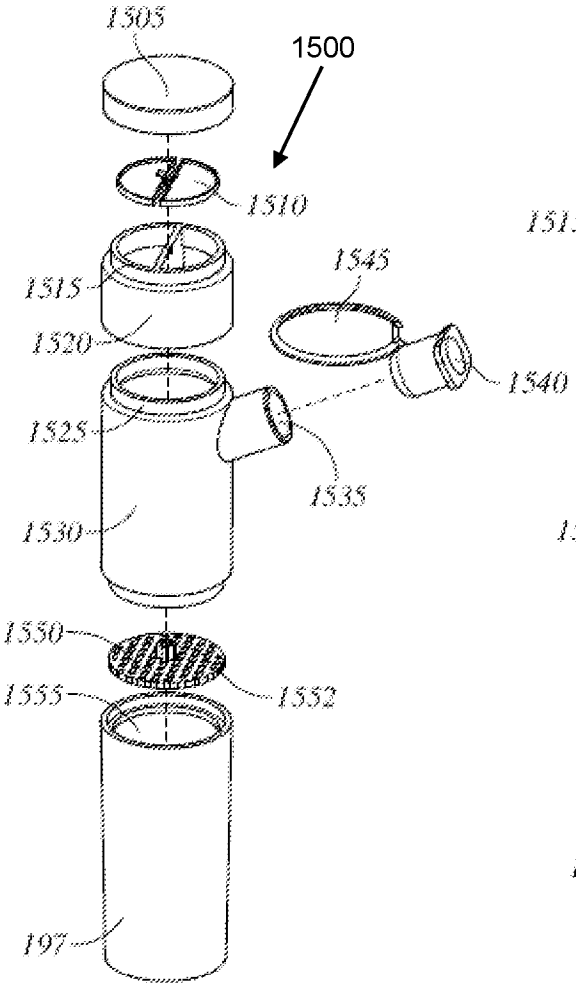

FIGS. 38, 39 and 40 show a depiction of an improved beverage container assembly in accordance with an exemplary embodiment of the present disclosure. More specifically, FIG. 38 shows an exploded view of an auxiliary container 1500 which is a small container. FIG. 39 shows a cross sectional view of a small container. FIG. 40 shows an alternative embodiment of an auxiliary container. Regarding FIGS. 38, 39 and 40 shows an auxiliary cap 1505 configured to be attached underneath a frame base when the auxiliary cup is not attached to the small container; shows an auxiliary compartments lid 1510 configured to cap the auxiliary compartments; shows an auxiliary compartments connector 1515 configured to connect the auxiliary compartments with its lid; auxiliary compartments configured to carry items including but not limited to powders, pre workout powder, post workout powder, energy powders, flavored powdered drink mix, dried beverage powders, powdered coffee, powdered tea, snacks, nuts, raisins, and other suitable contents; top container connector 1525 configured to connect auxiliary cap 1505 or auxiliary compartments 1520 depending on operating mode; top container 1530 configured to allow drinking blended or filtered beverages including but not limited to tea when for example, a tea bag may be placed in the bottom container which is auxiliary cup 197. In one or more embodiments, auxiliary cup 197 may be removed from the improved beverage container assembly and attached to apparatus 1500. Ice, loose tea, or other contents may be placed in the bottom container which is auxiliary cup 197; spout 1535 configured to allow for the drinking of beverages and for the pouring of beverages; 1540 tether cap plug configured to cap the beverages; tether cap 1545 configured to secure the position of the tether cap 1540 such that it does not fall or get misplaced during use; flat blender 1550 wherein the flat blender 1550 may also function as a filter to allow for the mixing of powders, filtering of tea bags, fruits for fruit infused beverages, and other filtered and blended contents; a flat blender holder 1552 configured to hold the flat blender 1550; a bottom container connector 1555 configured to allow for storage of tea bags, fruits, ice cubes and other contents; bottom container 197 also referred to as an auxiliary cup wherein the auxiliary cup may be used for collecting beverages or fluids from the large container. In one or more embodiments, the auxiliary cup may be attached underneath the large container to enable it to be securely positioned in a car cup holder; additional embodiments of auxiliary compartments 1510A and 1515A are configured to carry items including but not limited to powders, pre-workout powder, post workout powder, energy powders, flavored powdered drink mix, dried beverage powders, powdered coffee, powdered tea, snacks, nuts, raisins, and other suitable contents.

Figure 47:
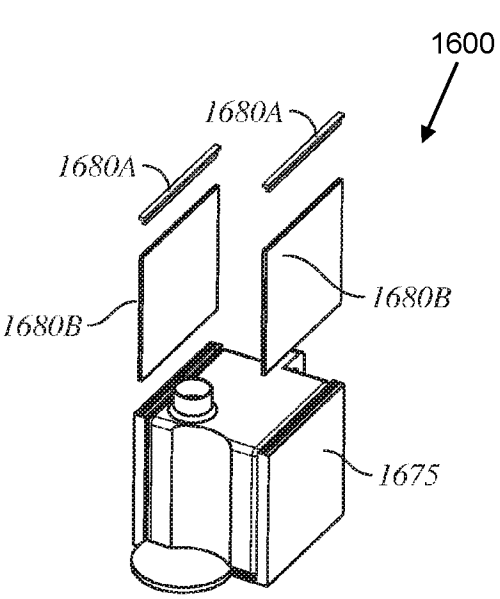
FIGS. 41, 42, 43, 44, 45, 46, 47 and 48 show a depictions of embodiments of beverage container assemblies in accordance with an exemplary embodiment of the present disclosure.
Figure 48:
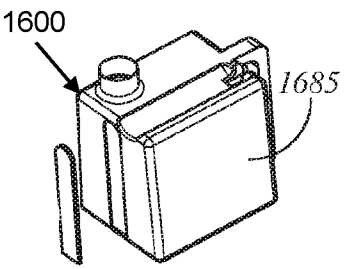
Figure 44:
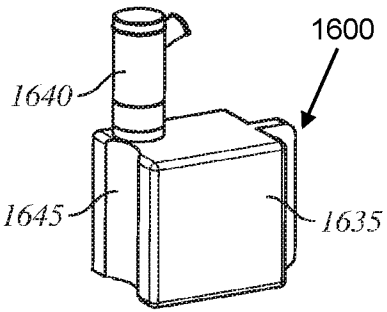
Figure 45:
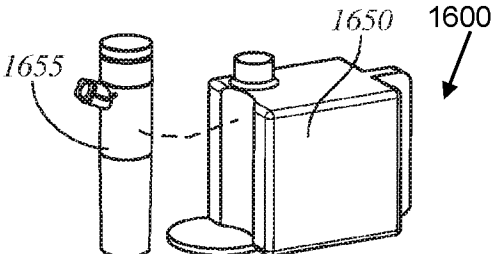
Figure 46:
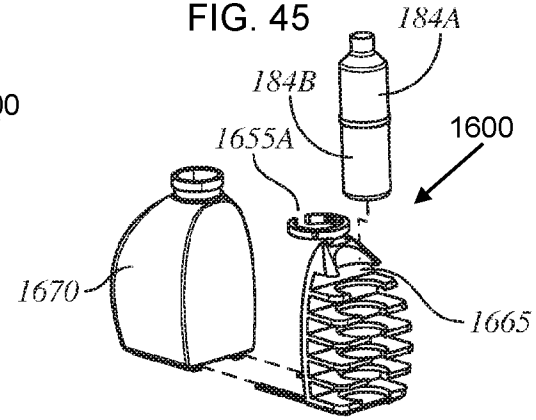
Figure 41:
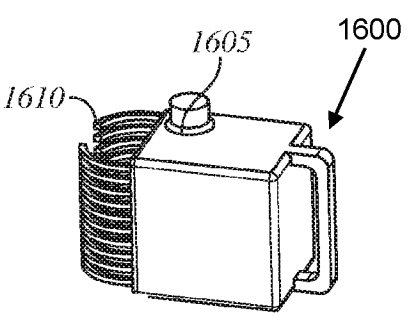
Figure 42:
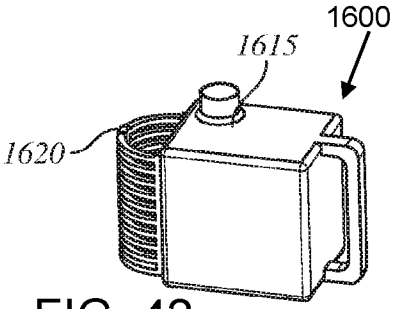
Figure 43:
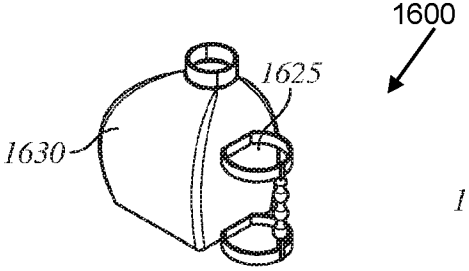

FIGS. 41, 42, 43, 44, 45, 46, 47 and 48 show a depiction of an improved beverage container assembly in accordance with an exemplary embodiment of the present disclosure. FIG. 41 shows a large container 1605 with external holder like fingers 1610 of an improved beverage container assembly, according to one embodiment of the present disclosure. FIG. 42 shows a large container 1600 with external holder like coil of an improved beverage container assembly, according to one embodiment of the present disclosure. FIG. 43 shows a large container with an external holder like one or more coil integrated with handle of an improved beverage container assembly according to one embodiment of the present disclosure. FIG. 44 shows a large container with a small cavity having no base, a small container for vertical top loading of an improved beverage container assembly, according to one embodiment of the present disclosure. FIG. 45 shows a large container with small cavity and base illustrating magnetic connection with a small container of an improved beverage container assembly, according to one embodiment of the present disclosure. FIG. 46 shows a simplified 3-dimensional integrated large container and a holder for a self-standing small container for an improved beverage container assembly, according to one embodiment of the present disclosure. FIG. 46 shows a small container top portion 184A configured to allow accommodation of an auxiliary cup on the top side of the assembly; a small container bottom portion 184B configured to allow accommodation of an auxiliary cup on the bottom side of the assembly; a bracket 1665 configured to allow the carrying of a small container; shows a bracket connector 1665A configured to allow for securing one or more brackets to a large container; a large container 1670 having a different shape. FIG. 47 shows a large container 1600 with cooling system of an improved beverage container assembly, according to one embodiment of the present disclosure. FIG. 48 shows large container 1685 displaying beverage level and another small container position in an improved beverage container assembly, according to one embodiment of the present disclosure.

Figure 49:
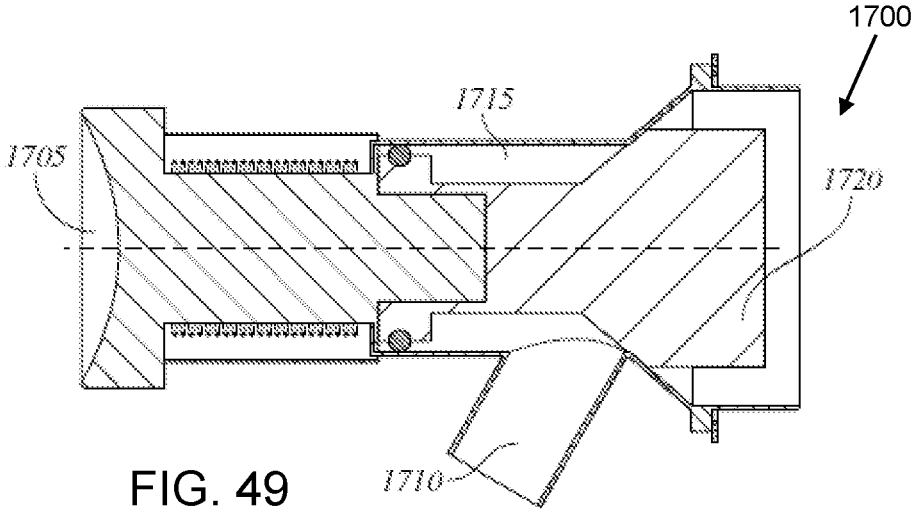
FIGS. 49 and 50 show a depiction of cross-sectional views of beverage container assemblies in accordance with an exemplary embodiment of the present disclosure.
Figure 50:
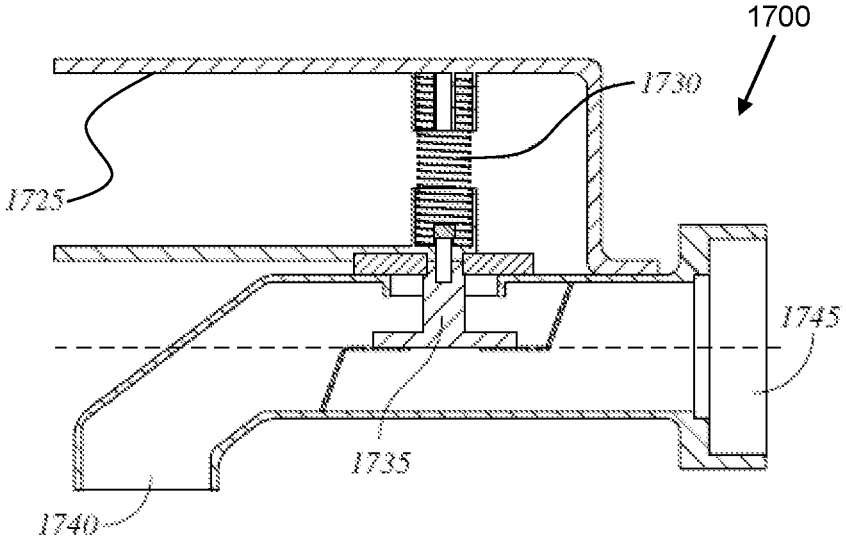

FIGS. 49 and 50 show a depiction of an improved beverage container assembly in accordance with an exemplary embodiment of the present disclosure. FIG. 49 shows a cross-sectional view illustrating push button type faucet of an improved beverage container assembly 1700. Regarding FIG. 49 shows a push button faucet comprising a push button 1705 with spring loaded and connected to the piston assembly 1720 by mans of thread or press fit or integral part. Push button 1705 and piston assembly 1720 connected assembly is enclosed in a housing 1715 with an O-ring which is not pictured. The O-ring may be configured to maintain the seal between the moving assembly and casing. The casing further comprising of the outlet port 1710 wherein, the beverage out flows from large container to small container. In one or more embodiments, the casing may be equipped with a gasket and nut, wherein the gasket seals the connection between faucet and large container.

FIG. 49 may be operated via the following method comprising the following steps. Firstly, pushing push button 1705 in linear motion such that it overrides the spring force. The linear movement of piston assembly 1720 enables the spring to compress which leaves the outlet port seal open thereby allowing the beverage to flow from large container to small container via casing outlet port 1710. Thereafter, releasing the push button 1705 and the spring retraction force cause the piston assembly 1720 to seal the outlet port thereby stopping the beverage flow from large container to small container via casing outlet port 1710.

FIG. 50 shows a cross-sectional view illustrating lift or push type faucet of an improved beverage container assembly 1700. Regarding FIG. 50 shows a push or lift lever assembly 1700 comprising a moving lever 1725 with spring loaded 1730 and connected to the piston assembly 1735 by means of thread or press fit. The other end of the spring may rest upon an upper fixed lever wherein, the upper fixed lever is further connected to casing 1745 by means of weld, thread or adhesive. The push or lift lever assembly may be enclosed in a housing with a gasket. The gasket configured to maintain the seal between the moving assembly and casing. The casing further comprising an outlet port 1740 wherein the beverage out flows from large container to small container. The casing may be equipped with another gasket and nut, wherein the gasket may seal the connection between faucet and large container. The faucet can be positioned perpendicular or parallel thereof, to the axis of the large container and position defines the operation of push or lifts the lever.

FIG. 50 an improved beverage container assembly 1700 may be operated via the following method comprising the following steps. Firstly, when positioned perpendicular to the axis of large container, lifting the moving lever 1725 and when positioned parallel to the axis of the large container, pushing the moving lever 1725 such that it overrides the spring force. The movement of piston assembly 1735 enables spring to compress which leaves the outlet port seal open thereby allowing the beverage to flow from large container to small container via casing outlet port. Thereafter releasing the lift or push lever and the spring retraction force causing the piston assembly 1735 to seal the outlet port 1740 thereby stopping the beverage flow from large container to small container.

Although the stages are disclosed in a particular order, it should be understood that the order is disclosed for illustrative purposes only. Stages may be combined, separated, reordered, and various intermediary stages may exist. Accordingly, it should be understood that the various stages, in various embodiments, may be performed in arrangements that differ from the ones claimed below. Moreover, various stages may be added or removed from the without altering or deterring from the fundamental scope of the depicted methods and systems disclosed herein.

FIGS. 1-50 within the disclosure sets forth the operating modes involved consistent with an embodiment of the disclosure for providing an improved beverage container system, assembly and apparatus. The operating modes include a transport mode, a dispensing mode, and an elevated position, a retracted position, a dispensing position, and a compressed position depending on the embodiment of the improved beverage container assembly.

FIGS. 4 and 5 show perspective views of the improved beverage container assembly 100 in a transport mode and 100 in a dispensing mode. FIG. 1E, 100 shows the improved beverage container assembly in a dispensing mode which may also be referred to as a piggyback mode.

We claim:

1. An improved beverage container assembly comprising:

at least a pair of beverage containers including a larger container and a smaller container disposed in a containment portion of the larger container;

the larger container includes a pair of side wall portions, a front end portion, a rear end portion and a top open end portion with an opening for receiving a cap member, the pair of side wall portions having a guide and roller member disposed at a bottom end thereof for selectively positioning the larger container in multiple positions defining a storage and transport mode and a dispensing mode, the front end portion includes a valving and protective device at bottom end thereof and a handle member attached at a location on the rear end portion for carrying and moving the larger container between the storage and transport mode and the dispensing mode; and a carrier device having a frame base member with a top base surface for supporting the larger container thereon, a pair of upstanding frame members that are removably attached to a pair of opposite side walls of the frame base member for slidably guiding the larger container between the multiple selective positions, and a front frame base open wall end and a rear frame base open wall end disposed at opposite ends of the frame base member.

2. The improved beverage container assembly according to claim 1, wherein the larger container further includes an elongated and hollow basket member with a plurality of slots about its entire length, the elongated and hollow basket member having a top open end and a closed bottom end and extending from a top open end opening into an interior of the larger container to a location adjacent a bottom thereof, and a cap secured to the top open end of the elongated and hollow basket member for closing the elongated and hollow basket member.

3. The improved beverage container assembly according to claim 2, wherein the elongated and hollow basket member stores items selected from the group consisting of fruits, vegetables or ice to be fused with a liquid within the larger container via the plurality of slots in the basket member.

4. The improved beverage container assembly according to claim 1, wherein the top base surface of the frame base member adjacent the front frame base open wall end includes an opening that receives a lower end portion of the smaller container, a plurality of slots for beverage draining surrounding the first positioning opening to allow for waste beverage to pass through, the front frame base open wall end includes an opening for receiving a sliding accessory compartment therein to collect a waste beverage therein, the sliding accessory compartment having a handle member disposed on one end of the sliding accessory compartment that is exposed to the exterior when fully inserted within the opening to grasp and slide the sliding accessory compartment drawer therein and to remove the sliding accessory compartment from the opening, a sponge disposed within said sliding accessory compartment to absorb any spilled liquid within the sliding accessory compartment and the sponge including an opening in the sponge aligning with the opening for the small container to further stabilize the smaller container therein.

5. The improved beverage container assembly according to claim 1, wherein the rear frame base open wall end includes an opening for receiving an accessories storage drawer therein to store accessory items therein, the accessories storage drawer having a handle member disposed on one end of the accessories storage drawer that is exposed to the exterior when fully inserted within the opening to grasp and slide the accessories storage drawer therein and to remove the accessories storage drawer from the opening.

6. The improved beverage container assembly according to claim 1, wherein the smaller container comprises a first container that includes a first magnetic cap lid removably attached to a top open end thereof, the first magnetic cap lid having a first lid opening with first magnets disposed on opposite sides of the first lid opening with opposite pole orientations, a first lid closure member for opening and closing the first lid opening for filling, dispensing and non-dispensing, a first base magnet member disposed in a lower end of the first container, the first base magnet member having second magnets with opposite pole orientations, a second container that includes a second magnetic cap lid removably attached to a top open end thereof, the second magnetic cap lid having a second lid opening with third magnets disposed on opposite sides of the second lid opening with opposite pole orientations, a second lid closure member for opening and closing the second lid opening for filling, dispensing and non-dispensing, a second base magnet member disposed in a lower end of the second container, the second base magnet member having fourth magnets with opposite pole orientations, the second container coupled to the lower end of the first container below the first base magnet member and securely connected thereto when the opposite pole orientations of the second magnets at the first base magnet member of the first container and the third magnets at the second magnetic cap lid of the second container are moved until the second magnetic cap lid becomes magnetically attracted to the first base magnetic member, the second container is released from the first container when the third magnets at the second magnetic cap lid of the second container are moved to a position where the second magnets at the first base magnet member of the first container are no longer magnetically attracted to the third magnets, and wherein the first container and second container are interchangeably connected to one another.

7. The improved beverage container assembly according to claim 6, wherein the first or the second magnetic cap lids, the first or the second base magnet members and the sealing base member can be connected by fastening means selected from the group consisting threading, press fitting, welding, snap fitting, adhesives, insert molding, blow molding, vacuum insulated, and other mechanical type fastening means.

8. The improved beverage container assembly according to claim 1, wherein the valving and protective device includes spring based valve member and a hinged cover for protecting the valve member from damage and dust.

* * * * *